US007325805B2

(12) United States Patent
Ritchie et al.

(10) Patent No.: US 7,325,805 B2
(45) Date of Patent: Feb. 5, 2008

(54) MUSIC THEORY GAMES AND METHODS OF PLAYING MUSIC THEORY GAMES

(75) Inventors: Sally Ritchie, Shiocton, WI (US); Sharon Ragner, Shiocton, WI (US)

(73) Assignee: Whirligig, LLP, Shiocton, WI (US)

( * ) Notice: Subject to any disclaimer, the term of this patent is extended or adjusted under 35 U.S.C. 154(b) by 84 days.

(21) Appl. No.: 11/247,077

(22) Filed: Oct. 11, 2005

(65) Prior Publication Data

US 2006/0076733 A1 Apr. 13, 2006

Related U.S. Application Data

(60) Provisional application No. 60/618,020, filed on Oct. 12, 2004.

(51) Int. Cl.
*A63F 3/00* (2006.01)

(52) U.S. Cl. ..... 273/259; 273/277

(58) Field of Classification Search ..... 273/244, 273/259, 273, 277

See application file for complete search history.

(56) References Cited

U.S. PATENT DOCUMENTS

| | | | |
|---|---|---|---|
| 702,298 | A | 6/1902 | Frederickson |
| 1,139,098 | A | 5/1915 | Bostwick |
| 1,189,450 | A | 7/1916 | Hofer |
| 1,217,810 | A | 2/1917 | Noel |
| 1,338,475 | A | 4/1920 | Haris |
| 1,392,977 | A | 10/1921 | Swan |
| 1,589,878 | A | 6/1926 | Gilbert |
| 1,599,568 | A | 9/1926 | Koehler |
| 1,675,528 | A | 7/1928 | Bishop |
| 2,086,864 | A | 7/1937 | Gerber |
| 2,231,020 | A | 2/1941 | McCaulley |
| 2,582,544 | A | 1/1952 | Johnson |
| 3,994,500 | A | 11/1976 | Schow |
| 4,061,337 | A | 12/1977 | Callender |
| 4,465,282 | A | 8/1984 | Dillon |
| 4,819,539 | A | 4/1989 | Searing |

(Continued)

OTHER PUBLICATIONS www.whirligigllp.com.*

*Primary Examiner*—Vishu K. Mendiratta
(74) *Attorney, Agent, or Firm*—Andrus, Sceales, Starke & Sawall, LLP

(57) ABSTRACT

A game and a method of playing a game are provided that teach the concepts necessary for a polished musical performance. In one embodiment, the game comprises a game board that provides a path of movement for a playing pawn controlled by each player. The path of movement comprises a plurality of areas or "stores", each store designating a different category of music theory. The game also comprises means for directing each player as to how to move their respective playing pawn along the path of movement and into each of the plurality of stores. An object of the game is to successfully move a playing pawn into each one of the series of stores and correctly answer music theory questions relevant to the category of music theory covered by that store. In case the player does not have adequate understanding of a particular music category designated by a store, a separate game is provided to further develop the player's understanding of the category. Each separate game is played differently and apart from the board game and with different playing pawns, rules, etc. According to this method, students can, at separate times, play the individual games to help develop proficiency in those areas.

6 Claims, 32 Drawing Sheets

U.S. PATENT DOCUMENTS

| | | | | |
|---|---|---|---|---|
| 4,895,374 | A | 1/1990 | Bowles | |
| 5,016,889 | A | 5/1991 | Moss et al. | |
| D339,610 | S | 9/1993 | Barriault | |
| 5,496,179 | A | 3/1996 | Hoffman | |
| 5,540,132 | A | 7/1996 | Hale | |
| 5,599,022 | A | 2/1997 | Ben-Horin | |
| 5,709,552 | A | 1/1998 | LeGrange | |
| 5,893,561 | A | 4/1999 | Hoffman | |
| 6,464,508 | B1 | 10/2002 | Ryan | |
| 6,491,300 | B2 * | 12/2002 | Harris et al. | 273/272 |
| 6,588,756 | B1 | 7/2003 | Hughes | |

* cited by examiner

Comment Cards

Wonderful performance! Proceed to a store of your choice and answer a question.

62

Comment Cards

You forgot to practice your scales--go to use the practice room and lose a turn

62

Figure 3

Level 1

| | |
|---|---|
| It's All Relative | A minor sound is happy. True or False. Answer: false |
| NoteWordy | Name the letters of the music alphabet going up. Answer: ABCDEFG |
| Space Place | A step above C is ... Answer: D |
| Rhythm Riot | Define allegro. Answer: fast and lively |
| Composer Chaos | How many people are playing in a duet? Answer: two |
| Legato Lake | Piano means ... Answer: soft |
| Picnic Place | What does a composer do? Answer: Write music |

600

Figure 5

OSTINATO™

128

| | | | | | | | | | | | |
|---|---|---|---|---|---|---|---|---|---|---|---|
| ♯ | ♮ | ♭ | ♭♭ | ♮ | | | | | | | |
| 𝄐 | Cantabile | D.S. | 𝄋 | D.C. | | | | | | | |
| | Stretto | Dolente | | Fine | | | | | | | |
| | // | Acced. | Agitato | Maestoso | Dolce | | | | | | |
| | meno | < | rall. | Leggiero | | | | | | | |
| | Molto | > | | rit. | Marcato | | | | | | |
| | con | Subito | | a tempo | ritenuto | | | | | | |
| | senza | poco | | | | | | | | | |
| | mezzo | | | | | | | | | | |

Figure 21

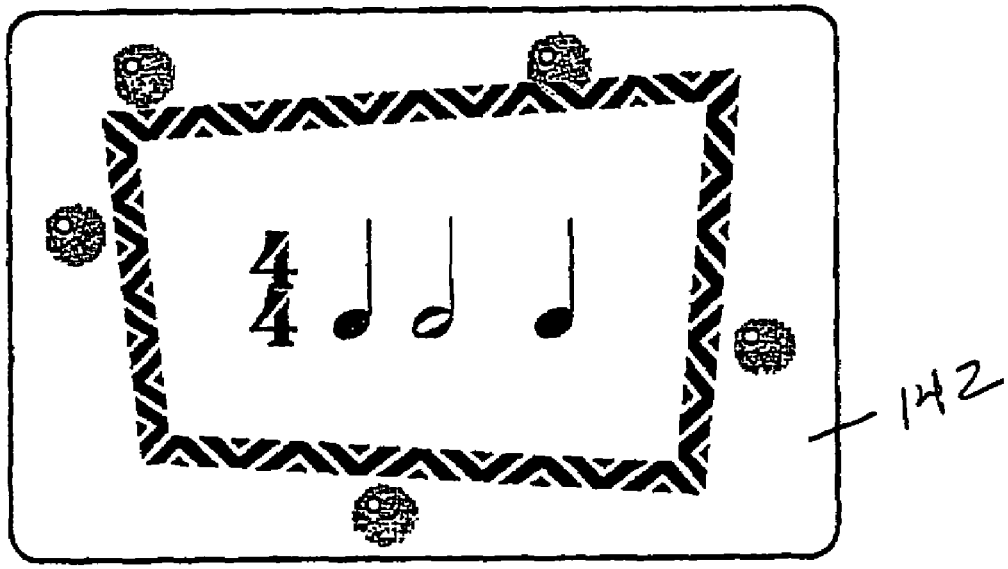
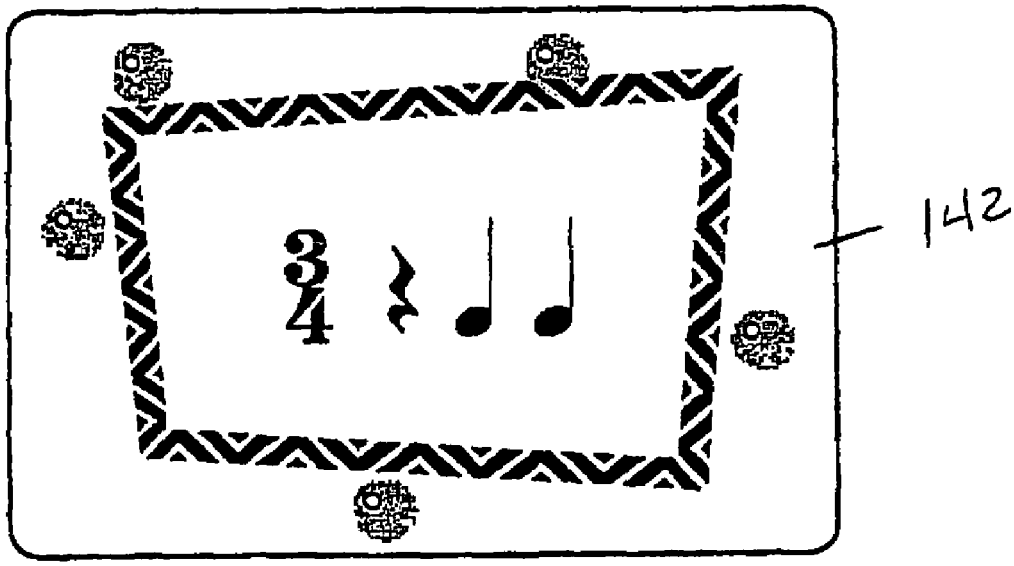
Figure 25

144

144

Tchaikovsky

Peter Ilyich Tchaikovsky
(1840-1893) Born in Russia
Romantic Era
Major Instrument: Piano

Famous Compositions:

piano:
Album for the Young Op 39 orchestra:
Piano Concerto No. 1 in B minor Op. 23
1812 Overture op 49
Symphony No. 6 Op 74 (Patheteque)

Ballet:
The Nutcracker
The Sleeping Beauty
Swan Lake

Figure 28

Nutcracker ballet

The Nutcracker Ballet dancers/orchestra

Based on "The Nutcracker and the Mouse King" by E.T.A. Hoffman

The Nutcracker is about a little girl who is given a nutcracker for Christmas. In her sleep she dreams that the nutcracker changes into a prince. The toys under the Christmas tree come to life and the prince leads them in a battle against the evil Mouse King.

Figure 29

Romantic Era

Romantic Era early 1800's to early 1900's
(1820-1900)

reflected a wide reange of feelings and emotions of the composer

Types of pieces popolar:

Character pieces
Concertos
Dances
Etudes
Variations

Figure 30

Ballet

Ballet

Performance by dancers, usually telling a story or portraying a mood. The dancing pantomimes the story.

Ballet has at times been part of an opera, but developed popularity as an independent genre in the nineteenth century.

Figure 31

MUSIC THEORY GAMES AND METHODS OF PLAYING MUSIC THEORY GAMES

CROSS REFERENCE TO RELATED APPLICATION

The present application is based on and claims priority under 35 U.S.C. § 119(e) of the U.S. Provisional Patent Application Ser. No. 60/618,020, filed Oct. 12, 2004, and entitled "METHODS OF PLAYING MUSIC THEORY GAMES". The U.S. Provisional Patent Application Ser. No. 60/618,020, filed Oct. 12, 2004, and entitled "METHODS OF PLAYING MUSIC THEORY GAMES" is also hereby incorporated by reference.

FIELD OF THE INVENTION

The present invention provides a game and a method of playing a game. The invention is arranged to teach the many concepts necessary to execute a polished musical performance regardless of the instrument or group of instruments being learned.

BACKGROUND OF THE ART

The use of games for teaching general music theory is known in the art. However, known music theory games are complicated, age-specific, and/or specifically directed to students having a certain level of understanding of music theory. In addition, known games fail to provide a music educator with the ability to assess the completeness of a student's understanding of the different musical concepts associated with proper performance of a music composition. Known games also fail to provide both (1) means for accurately identifying a particular music concept that a student misunderstands and (2) means for quickly improving the student's skills regarding that concept.

By the present application, it is recognized as desirable to provide a game and a method of playing a game that teach all aspects of music theory by individual category and according to different levels of skill. More specifically, it is desirable to provide a game and a method of playing a game that allow a music educator to accurately identify areas of weakness in a student's understanding of music theory. Such a game and method of playing a game must also provide means for quickly improving the student's understanding of the identified area of weakness.

SUMMARY OF THE INVENTION

A game and a method of playing a game are provided that teach the concepts necessary for a polished musical performance. In one embodiment, the game comprises a game board that provides a path of movement for a playing pawn controlled by each player. The path of movement comprises a plurality of areas or "stores", each store designating a different category of music theory, for example: note names, distance and direction in note reading in preparation for performance and chord construction, music terms and symbols, key signatures and scale degrees, rhythm and tempo, or music history.

The game also comprises means for directing each player as to how to move their respective playing pawn along the path of movement and into each of the plurality of stores. In the preferred embodiment, each player maneuvers a playing pawn around the path of movement by intervals or note names in an attempt to enter stores. An object of the preferred embodiment is to successfully move the playing pawn into each one of the stores and to correctly answer questions relevant to the particular category of music theory designated by that store. According to present invention, educators, such as teachers or parents are able to quickly identify areas of weakness in players' understanding of music theory, because each store specifically develops certain aspects of a musical performance or music knowledge.

In the particular example discussed below, game cards are provided for each category of music theory. Each game card has separate questions covering the music theory at different levels of difficulty. Thus, players having different levels of understanding of music theory can play together following the same instructions to play the game but answering the appropriate level questions to earn rewards/tokens. In a preferred embodiment the questions are presented at three different levels, for example beginner, intermediate, and advanced levels. Alternatively, higher level questions may be provided as an accessory.

In case a player does not have adequate understanding of a particular music category designated by a store, a separate game is provided to further develop the player's understanding of that category. Each separate game is played differently and apart from the board game and with different game equipment, rules, etc. According to this unique method, students can, at a different time, play the separate games to help develop proficiency in specific areas of music theory.

The game and method of the present invention thus advantageously allows an educator to quickly identify problematic areas of music theory and instruction, and then provides a specific method for developing that concept without having to spend time on other areas that perhaps don't need more work. The individual games can be faster and very specific, and thus teach each concept in a concise manner. As discussed above, prior art music theory games contain various questions and information, but not in specific areas, and not at different levels. Known music theory games also fail to develop individual concepts so that in many cases, a player can win the game without actually addressing many important theory components of the game.

In addition, known music theory games do not deal with the wide range of the individual concepts that the present invention does, i.e. notes, rhythms, key signatures, time signatures, tempo, articulation, and dynamics, and also composers, style, eras, form and construction, instrumentation, and harmonization, among others, in a manner that makes it necessary for every player to address each area, every time the game is played. Known games may ask questions in several of these areas but only by chance. Unlike known music theory games, the present invention ensures that music students understand many aspects of music theory other than notes and rhythms. This unique attribute overcomes a main reason for incomplete preparation or substandard performances in inexperienced musicians. While the specific questions that a player will have to answer each time the game is played is at random, the category or theory concept is not.

BRIEF DESCRIPTION OF THE DRAWINGS

Preferred embodiments of the best mode of carrying out the present invention are described with reference to the following drawing figures.

FIG. 3 is a view of teacher comment cards for the board game.

FIG. 5 shows an exemplary Quest™ Card for the board game.

FIG. 21 shows a playing board for the Ostinato™ game.

FIG. 25 shows playing cards for the Rhythm Riot™ game.

FIG. 28 shows a composer card for the Composer Chaos™ game.

FIG. 29 shows a composition card for the Composer Chaos™ game.

FIG. 30 shows a time period card for the Composer Chaos™ game.

FIG. 31 shows a style/form card for the Composer Chaos™ game.

BRIEF DESCRIPTION OF EXEMPLARY EMBODIMENTS OF THE INVENTION

The following text describes preferred embodiments of the present invention pertaining to a game and method for teaching music theory. While specific designs for the game and instructions for the method are provided, it is to be understood that the following disclosure represents an example as to how to carry out the best mode of the present invention, which is more particularly defined in the appended claims. Changes can be made to the designs or layout of the playing board, playing cards, etc. within the scope of the present invention. In other words, the preferred embodiments described below are not described in a way to unnecessarily limit the breadth and scope of the claimed invention.

Board Game Description

Figure 1:
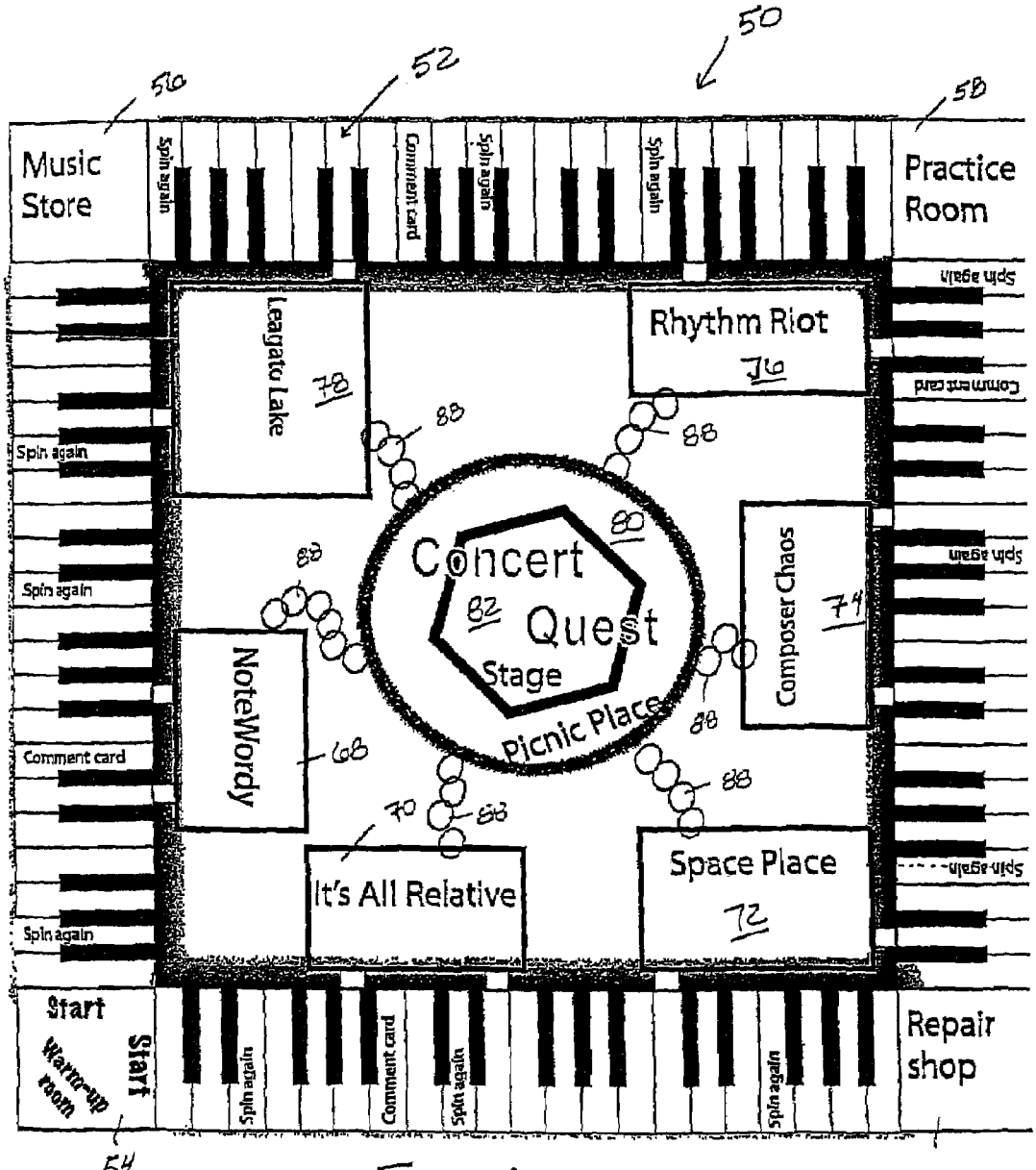
FIG. 1 is a plan view of a game board according to a preferred embodiment.
Figure 2:
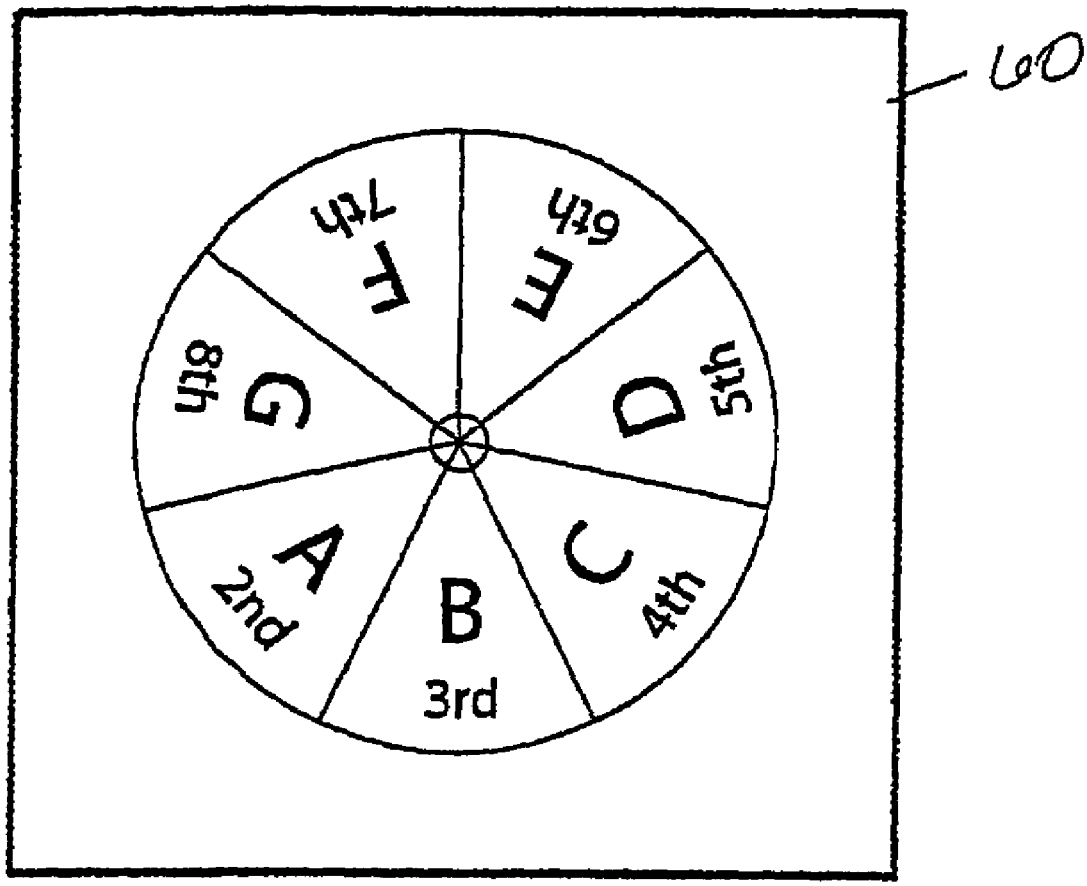
FIG. 2 is a view of a spinner for the board game.
Figure 4:
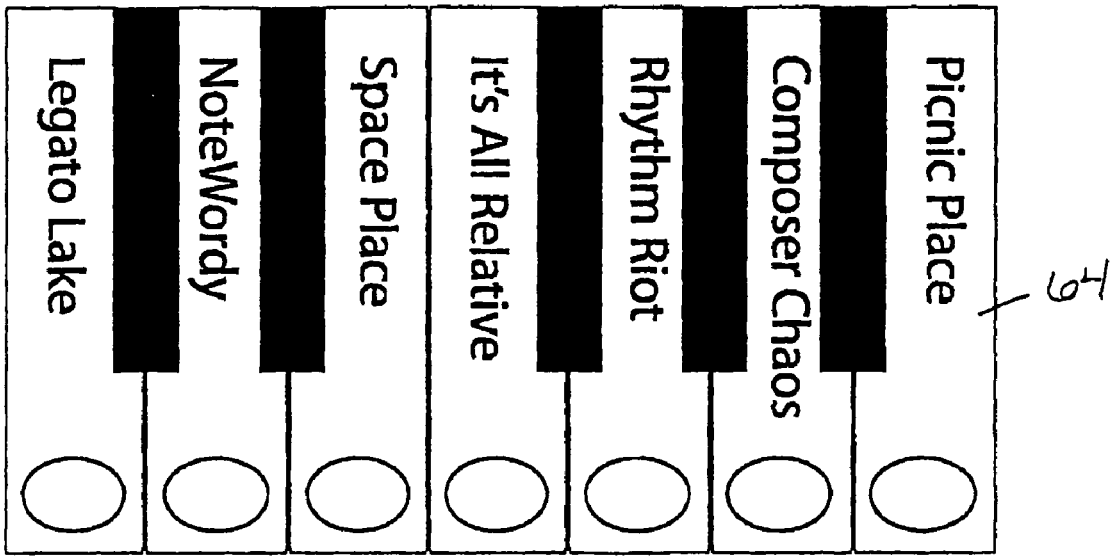
FIG. 4 shows a token recording board for the board game.

Referring to FIG. 1, a preferred embodiment of the present invention comprises a game board 50 having a path of movement comprising a piano keyboard design 52 around the perimeter of the board 50 and corner sections comprising warm-up room/starting position 54, music store 56, practice room 58, and repair shop 61. In addition, at least four playing pawns (not shown), a spinner 60 with all 7 note names and intervals ranging from 2nd through 8th (See FIG. 2), teacher comment cards 62 (See FIG. 3), store tokens (not shown), at least four token recording boards 64 (See FIG. 4) and Quest™ (music question) cards 66 (See FIG. 5). Quest™ cards 66 are separated into different levels ranging from late beginner through late intermediate and advanced.

The game board 50 also includes a plurality of music category areas or music "stores", each of which designate a separate category of music theory necessary for proper performance of a music composition. In the embodiment shown, the stores are also representative of separate "focus games", which will be explained hereinbelow. In the embodiment shown, the stores are designated by the names: NoteWordy™ 68, It's All Relative™ 70, Space Place™ 72, Composer Chaos™ 74, Rhythm Riot™ 76, and Legato Lake™ 78. Although not shown, a store may also/alternately be provided for CrossWordy™ and/or Ostinato™.

According to one example of the present method, an object of the game is to collect one token from each of the six music stores by correctly answering a question from that store category and then proceed to the picnic place 80 around the stage 82 and correctly answer a final question regarding a composer or a miscellaneous composition question. Upon answering the final question correctly, a player advances to the stage 82 to perform, thus winning the game.

Figure 6:
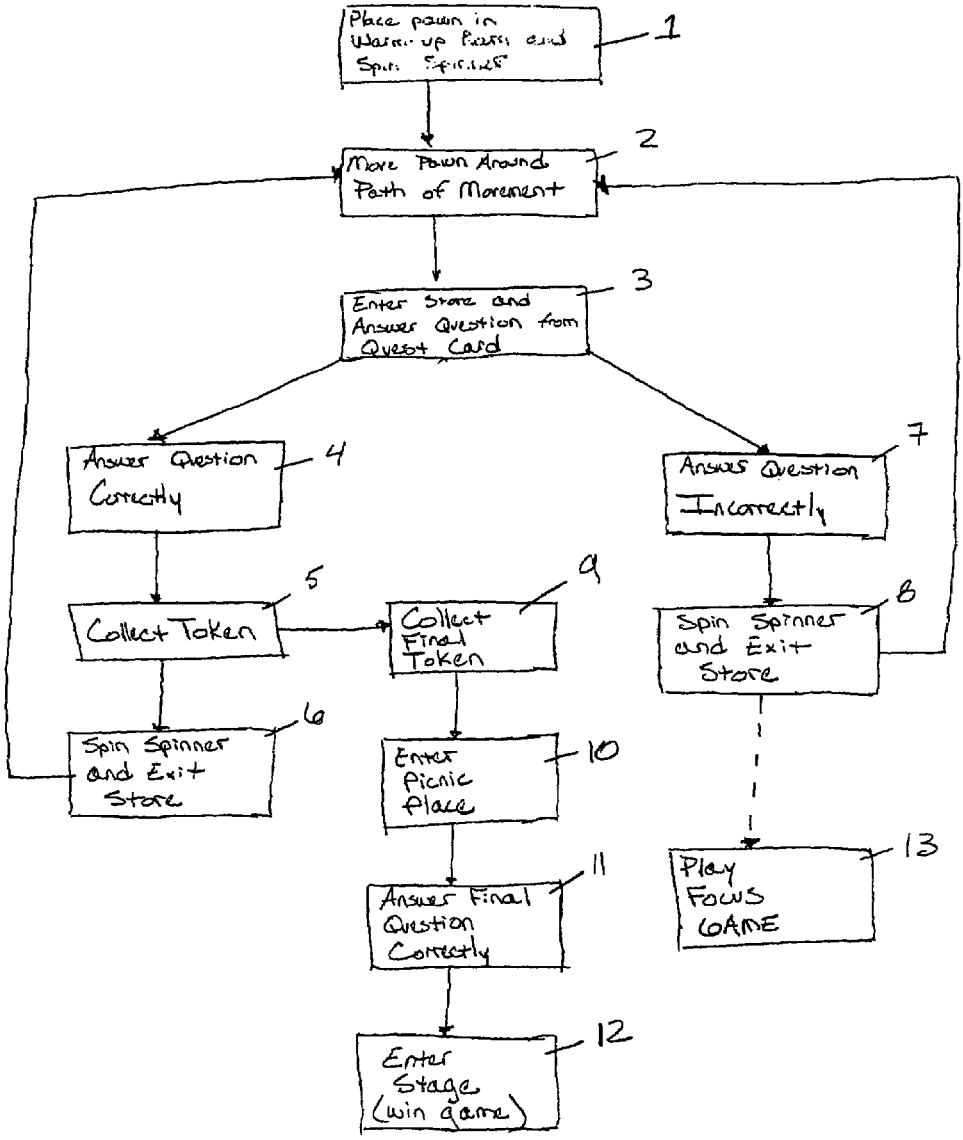
FIG. 6 is a flow chart showing steps in one example of a method of playing the preferred embodiment of the board game.

Referring to FIG. 6, the steps of an exemplary method of playing the game is shown. To start (step 1), players place their pawns on the space labeled "Warm Up Room" 54 and in turn spin the spinner 60. The spinner has 7 sections, each of which contains a note name (one of the letters of the music alphabet) and an interval. It is determined in advance whether players use the key names, or the intervals. Regardless of which is chosen, the first turn progresses in any direction by the key name. After that, it can be either note name or interval progression. Players proceed around the path of movement 52 of the game board 50 in either direction (step 2), with the objective of getting into each store 68-78 and earning a token by answering a music question correctly. Once inside a store (step 3), a question from the category contained in that store and the level appropriate to the knowledge level of that player is read from the Quest Cards 66. If the question is answered correctly (step 4), that player collects one token from that store (step 5). That player may leave the store from either door on his/her next turn (step 6). When leaving a store, players must proceed by using the note name rather than the interval. Subsequent moves can return to the movement by interval if that was the chosen method of play. If the question is answered incorrectly (step 7), the player loses a turn, spins the spinner 7 to exit the store (step 8) and re-enter the store on another spin (step 3).

If on the keyboard path 52, a player lands on a "spin again" key 84, another spin is then taken and the move is made in that same turn. If a player lands on a key marked "comment card" 86, the player draws a card 62 from the teacher comment deck and does whatever is indicated on that card 62. For example, the teacher comment card 62 may penalize the player by requiring him/her to move their pawn to the music store 56, practice Room 58 or Repair Shop 61 and/or lose a turn.

Upon collecting a token from each of the six stores 68-78, on the perimeter 52 of the game board 50 (step 9), the player proceeds through the back door 88 of the store where the final token was received, to the picnic place 80 (step 10) and must answer a question correctly (step 11) to enter the stage 82 (step 12) for the performance, thereby winning the game. If the player answers the final question incorrectly, he/she must try again on his/her next turn.

During the process of playing the game, players and teachers may notice weaknesses that become evident when individuals have trouble answering questions in particular stores concentrating on specific competencies. A unique aspect of the board game is that each store has its own focus game that can be played independently of the board game 50 (step 13). The focus games are described individually below.

In summary, a musical performance is made not only of notes and rhythms but also many other aspects. This uniquely addresses those many components and gives the student a way to increase the likelihood that he/she will understand the many facets required for a quality performance. For example, if when playing the board game, a student has a difficult time answering a question in the Space Place™ store to earn his/her token, he/she then knows that by playing the separate game, The Space Place™, he/she can learn to identify and be competent in the understanding of intervals. If a weakness is identified by a problem in Composer Chaos™, that game can be played at another time and thus work only on that concept instead of having to replay the board game (which is commercially referred to as "Concert Quest"™) over enough times to get more work on that specific area.

Focus Game Descriptions

The following are details about each focus game associated with the board game. Each focus game is a separate entity to be played independently of the board game and is designed to teach specific music theory concepts and concentrate on areas that need extra attention. Briefly, for example, if a player is having trouble recognizing note names, the teacher can play NoteWordy™ with the student to correct this deficiency. A student having trouble with intervals will only need to play Space Place™ to increase his/her ability and become proficient at differentiating between them. In like manner, Ostinato™ and Legato Lake™ will make recognition of music terms and symbols easy. It's All Relative™ is a game that makes learning key signatures and scale construction an much more enjoyable experience. Rhythm Riot™ teaches rhythms, tempo, and time signatures with ease. Composer Chaos™ is a game that works on musical form and style along with an understanding of the background of individual composers and compositions.

NoteWordy™

Figure 7:
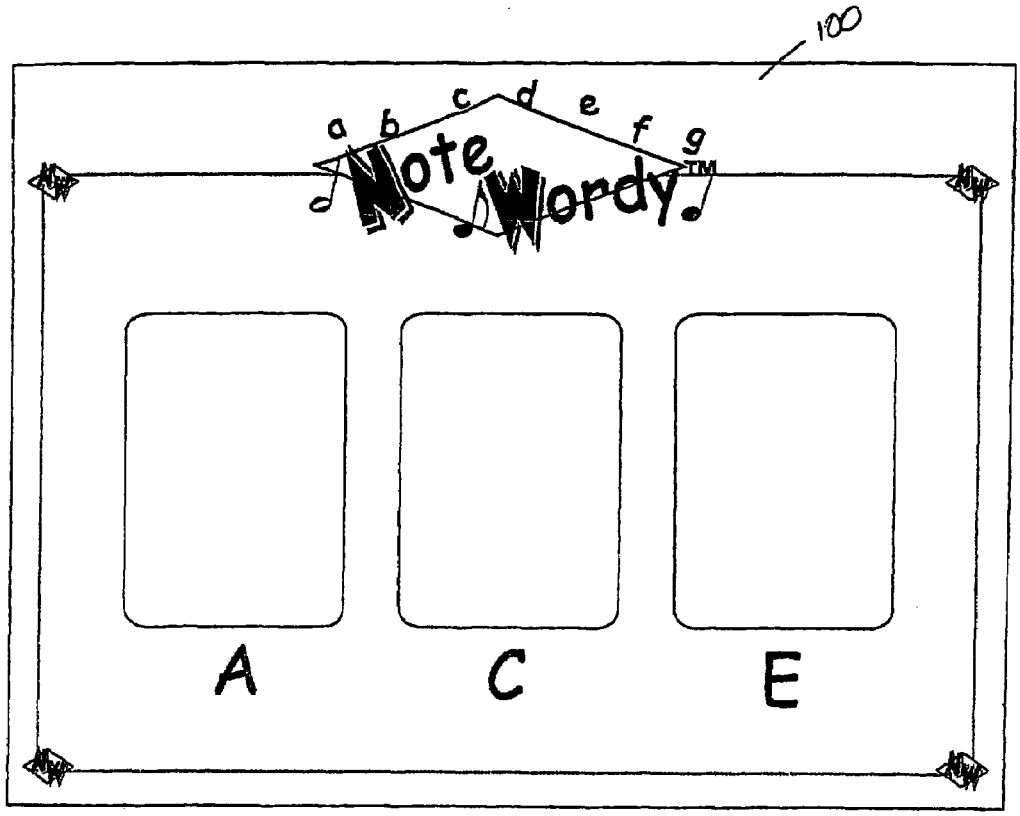
FIG. 7 shows a Level 1 game board for the NoteWordy™ game.
Figure 8:
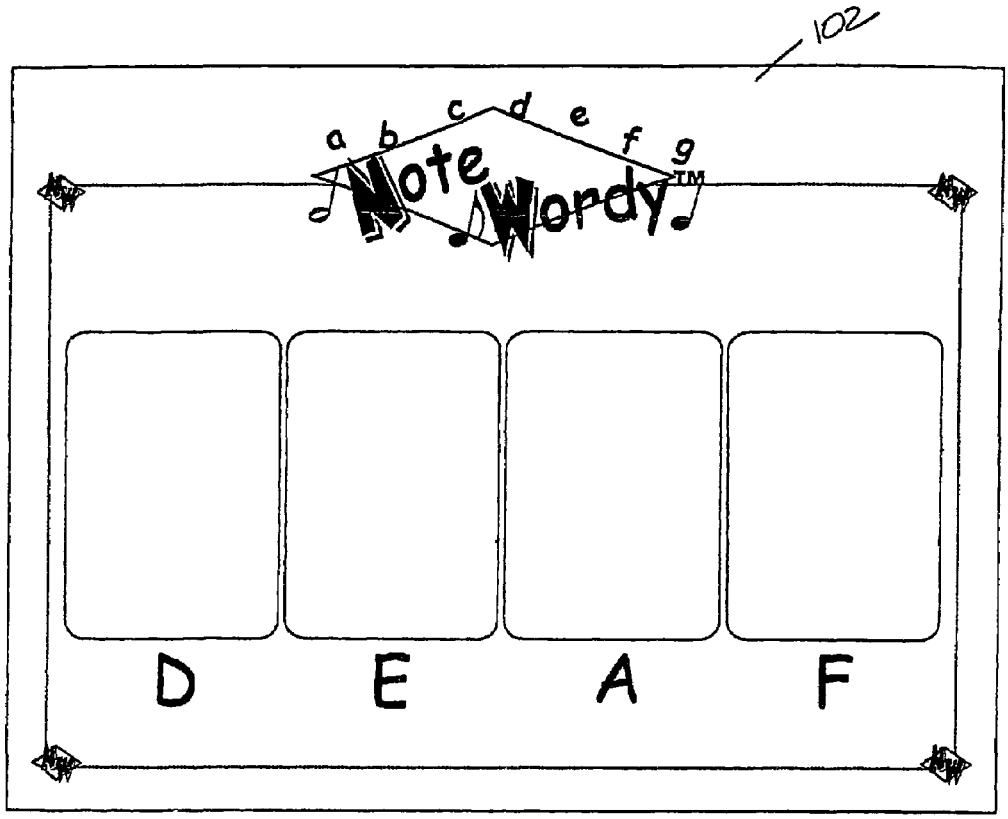
FIG. 8 shows a Level 2 game board for the NoteWordy™ game.
Figure 9:
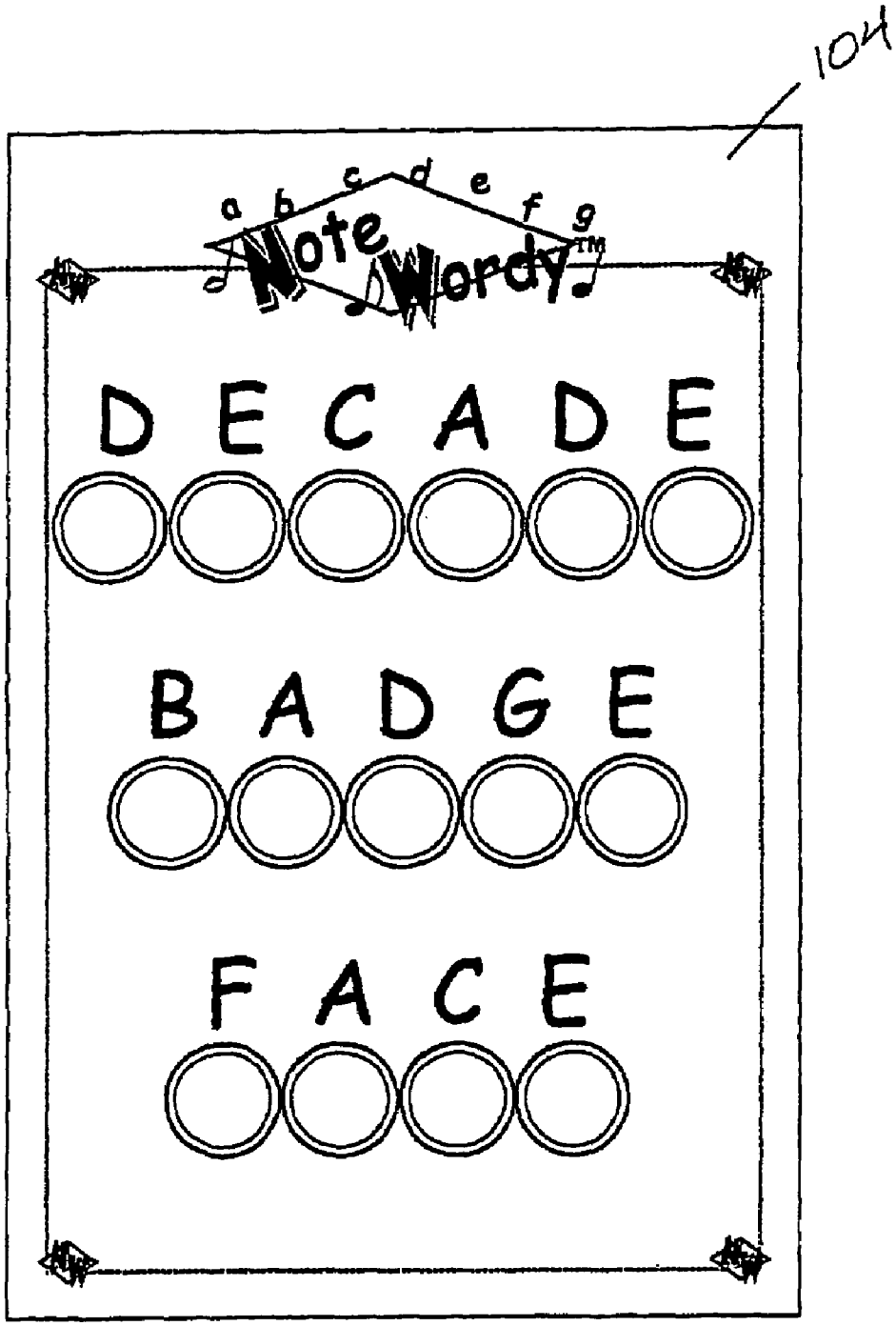
FIG. 9 shows a Level 3 game board for the NoteWordy™ game.
Figure 10:
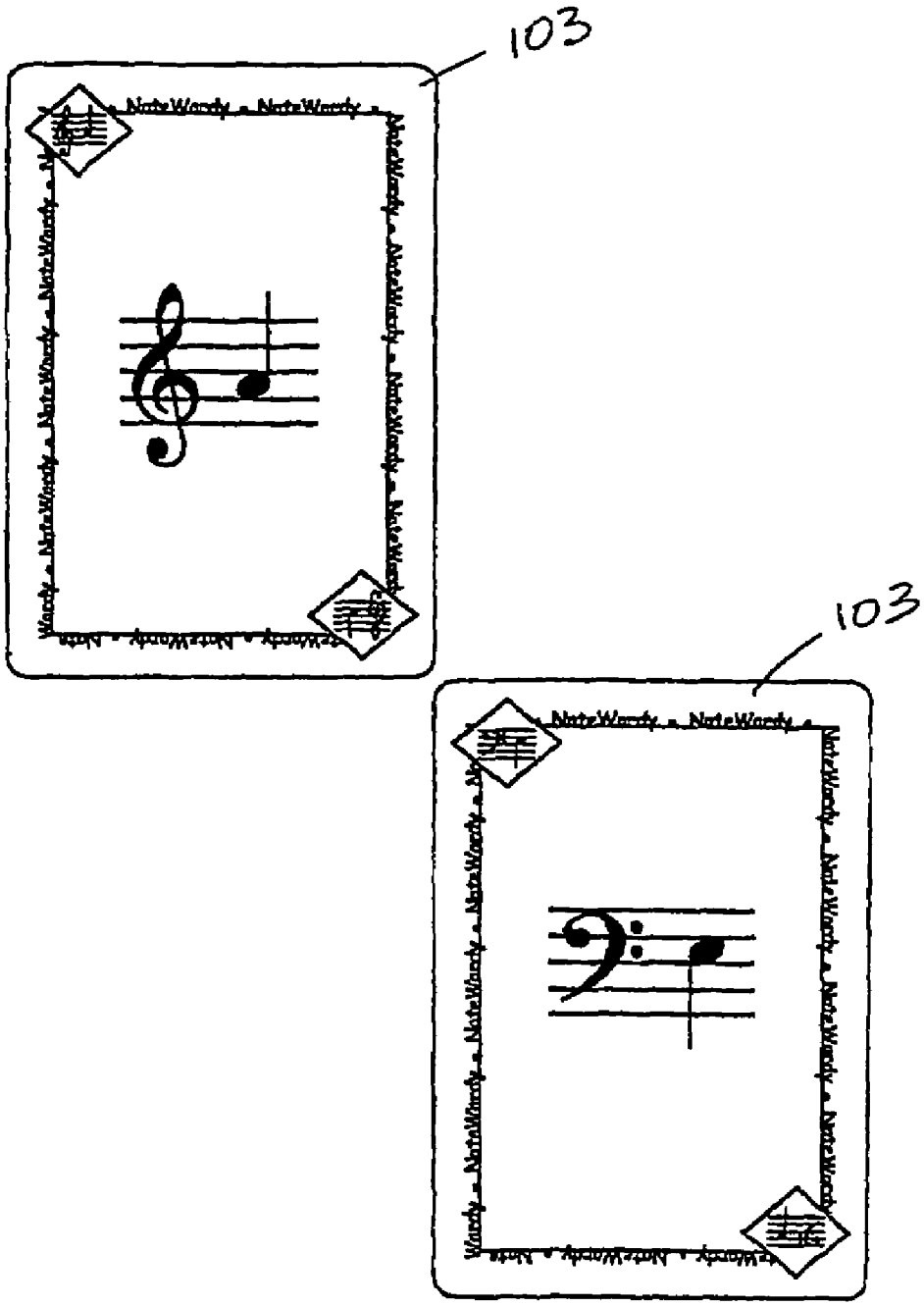
FIG. 10 shows playing cards for the NoteWordy™ game.

NoteWordy™ is a game that helps students acquire a speedy recognition of note names by racing to complete words. The game has many variations and can be adapted to many different situations. Players choose a game board 100, 102, 104 (See FIGS. 7-9) with a word written on it and card shaped silhouettes above of each letter of their word. The players are then dealt cards 103 (See FIG. 10) corresponding to the number of letters in their word. Players take turns drawing cards from the remainder of a note name deck (not shown) and discarding cards until they have collected all the letters needed to form the word indicated on the game board 100, 102, 104. Variations can include rule changes for playing the games, the length of the words, and level of the deck of cards.

In the exemplary embodiment, there are three levels of game boards and card decks. For Level 1 (See FIG. 7) the game board 100 includes 3-letter words and notes ranging from bass F (the fourth line of the bass staff) through treble G (the second line of the treble staff). For Level 2 (See FIG. 8) the game board 102 has 4-letter words and notes ranging from low G (bottom line of the bass staff) through high G (the first space above the treble staff). For Level 3 (See FIG. 9) the game board 104 contains three words of different lengths. The card deck for this level includes notes on both staves ranging from the second ledger line below through the second ledger line above each staff. The illustrations include but are not limited to the words and notes indicated.

Hereinbelow is provided an example of a detailed set of instructions for playing the NoteWordy™ game.

Setup:

- Each player chooses a word board with a 3-letter word on it.
- To determine who goes first, each player draws one card. The card with the note closest to Middle C starts first. In the event of a tie, everyone draws over.

The Game:

- Players are each dealt 3 cards. The remainder of the deck is used for the drawing deck. The top card gets turned face up and placed beside the drawing pile to start the discard pile.
- The first player draws a card either from the drawing pile or the discard pile.
- If that player has a card that matches one letter of his/her word, it is then placed on the card silhouette above the letter. The player then discards one card from her/his hand and places it on the discard pile. (The number of cards remaining in her/his hand at the end of the turn must be the same as the number of blank spaces on the word card.) The turn is over.
- The next player can choose to either draw from the drawing pile or take the top card from the discard pile.
- Play continues in this manner until one player has completed his/her word.
- Each person may play only one card on the word in a turn.
- If after drawing a card a player does not have anything to place on her/his word, he/she discards and the turn is over.
- In the event that the drawing deck is gone, the discard deck is shuffled and used as the new drawing deck.
- Wild cards may be used as any letter.

Alternate Ways to Play:

Variation A: In this game the players do not lay down any cards or markers on their board until the complete word is spelled. The opponents then know what letters are needed but not which of those letters the player already holds in his/her hand. The play progresses in the same manner as the original game.

Variation B:

Each player chooses a word from the list of suggested words or one that he has thought of by himself. Before the game begins players must agree on the length of the words that will be used.

Players are each dealt the number of cards corresponding to the amount of letters in the words that were chosen. (The remainder of the deck is used for the drawing deck with the top one turned face up and placed beside the drawing pile to form the discard pile.)

The play progresses in the same manner as the original game with the winner being the first person to lay down a complete word with the amount of letters agreed upon.

Level 3: The Complete Board Game:

Each player chooses a word board

Players are each dealt 4 cards. (The remainder of the deck is used for the drawing deck.)

The first player places a card in the discard pile and declares that note name. He/she then proceeds to place a marker on the circle below any one letter on the board that corresponds with that note name.

After playing a note card he/she then draws a new card from the draw pile keeping his/her hand at 4 cards.

Play continues in the same manner.

When a player has a "dead hand" (none of the 4 cards in his/her hand are available letters on his/her own board) the cards are put into the discard pile one by one, with the notes being identified as the discard occurs. Next, a new hand of 4 cards is drawn. The turn is then over and no card may be played until the next turn.

The game is over when one player has covered all letters on his/her game board. That person is the winner.

Alternate Rules: When a note is identified, all players may cover one corresponding letter on their playing boards. (A card may be considered "dead" if it isn't available on a player's own playing board even if other players still have that letter available)

Variation: Players must complete the top word on their boards before proceeding to the next word. If a player does not have any of the remaining letters needed in his/her hand, he/she surrenders one card to the opponent on his left who can mark that letter (only one) anywhere on his/her game board. That card is replaced by drawing a card from the drawing pile.

CrossWordy™

Figure 11:
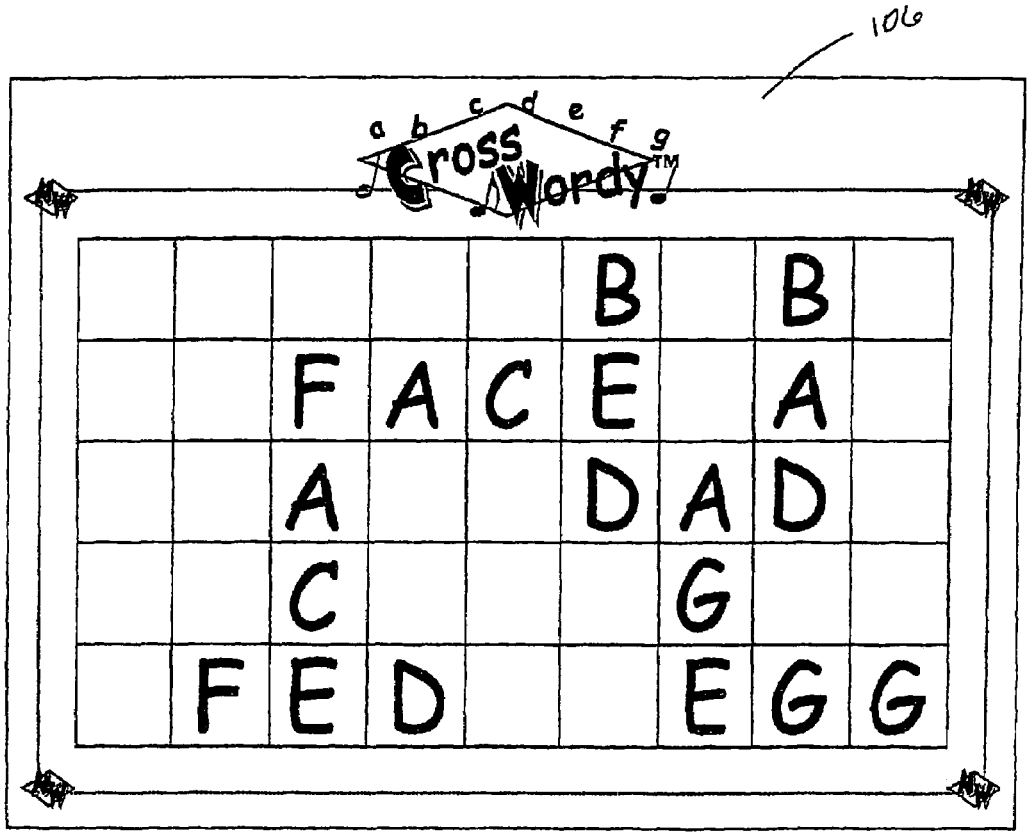
FIG. 11 shows a Level 1 playing board for the CrossWordy™ game.
Figure 12:
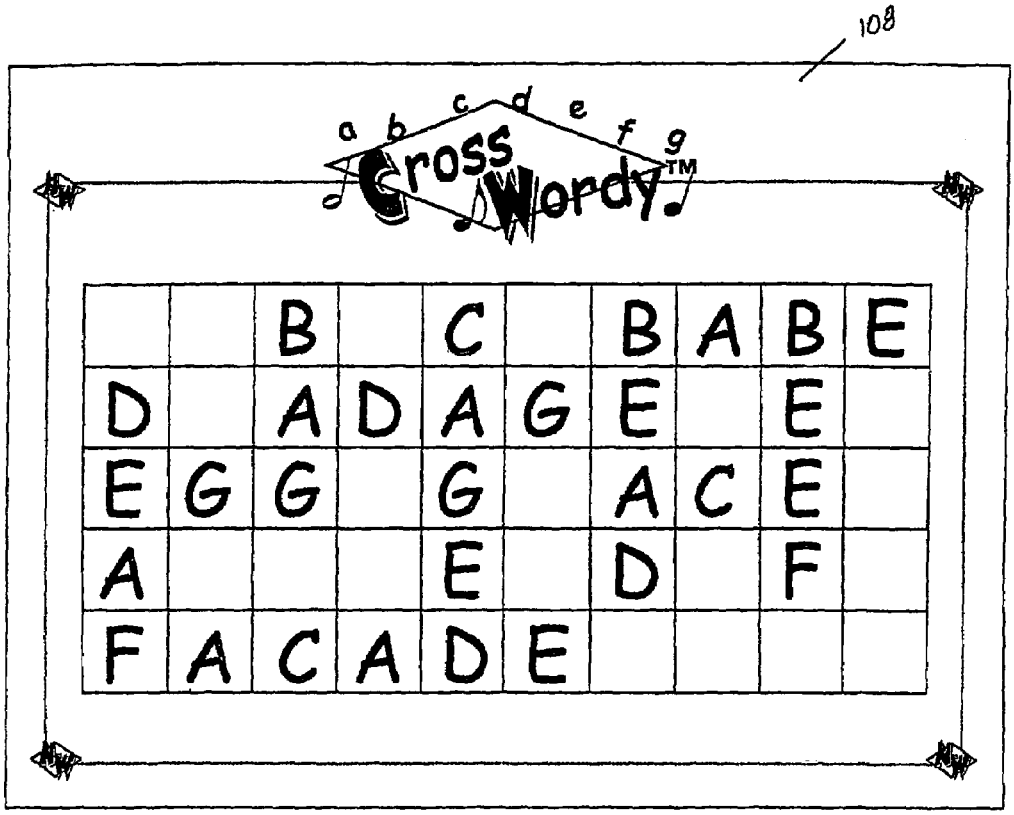
FIG. 12 shows a Level 2 playing board for the CrossWordy™ game.
Figure 13:
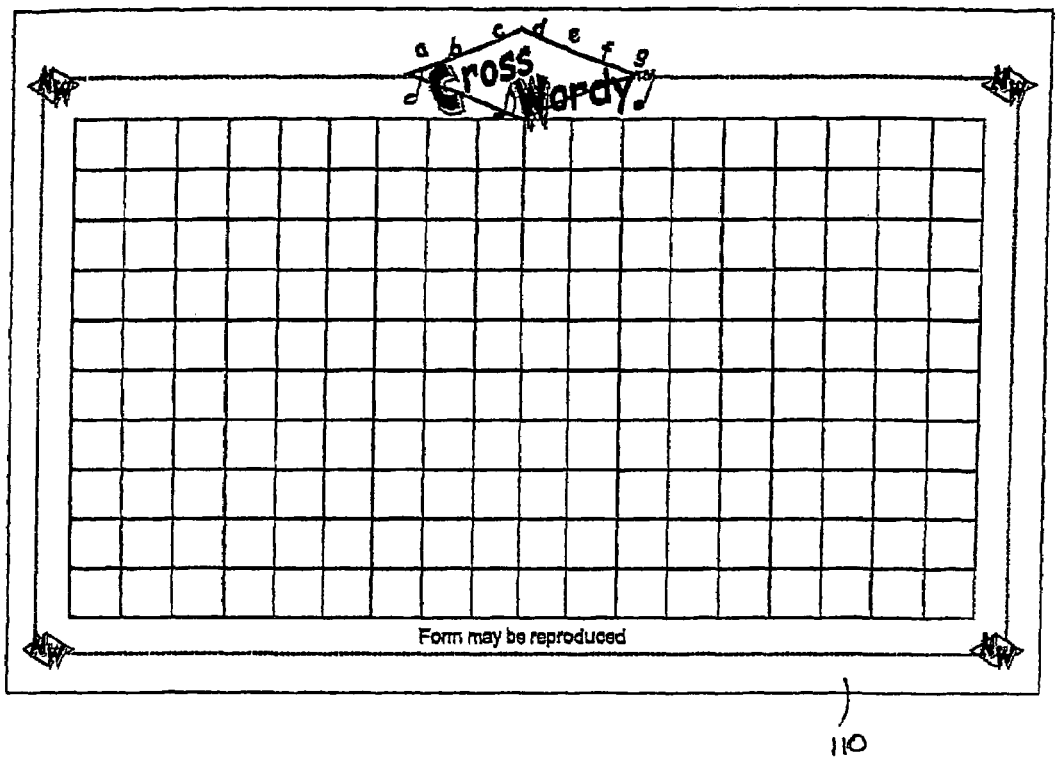
FIG. 13 shows a Level 3 playing board for the CrossWordy™ game.

CrossWordy™ is a game whereby players compete to finish words on a crossword grid. The letters and words are printed on the grid and players cover with a note marker, letters that match the names of the notes on their "hand" of cards. Points are earned by completing words on the grid. Each Level 1 (FIG. 11) and 2 (FIG. 12) game includes at least two CrossWordy™ grid game boards 106, 108, respectively. Level 3 (FIG. 13) contains blank CrossWordy™ grids 110 so that players make their own crossword board. As with NoteWordy™, there are many variations of play with this game. The illustrations include but are not limited to the words and notes indicated.

This game is different from other previous games in that each level has a deck of cards that concentrate on a different area of the grand staff. Some versions of the game can be completed in about 5 minutes and target the specific competency of note reading. The CrossWordy™ game adds a different type of strategy and requires that players not only identify notes but also need to be aware of their opponents plays—since they are playing on the same game board—so that they can use strategy to obtain the most points.)

Hereinbelow is provided an example of a detailed set of instructions for playing the CrossWordy™ game.

Setup:

There is one CrossWordy board for everyone to share.

The multi-colored game pieces are made available to all of the players.

The Game:

Players are each dealt 4 cards.

Player One lays a card in the discard pile and declares that note name. He/she then places a letter marker on a letter on the game board that corresponds with that note name. She/he then draws a new card from the drawing deck to replace the one that was just played, and the turn is over.

Players take turns playing their cards and placing their markers on letters until a player completes a word. That player then receives one point per letter in that word.

If the placement of the letter marker completes two words, the player gets points for the total number of letters in each word. The letter that is included in both words gets counted twice, once for each completed word.

When a player has a "dead hand" (none of the 4 cards in his/her hand are available letters on the board) the cards are put into the discard pile one by one, with the notes being identified as the discard occurs. Next, a new hand of 4 cards is drawn. The turn is then over and no card may be played until the next turn.

The game is over when all letters are covered with markers. The winner is the player with the most points.

Variation D: CrossWordy

A blank CrossWordy sheet is placed between the players. (This game can also be played with each player using a blank crossword sheet of his/her own.)

Players are each dealt 7 cards

The first player must spell a word using the note names in his/her hand. Proper nouns are not allowed.

He/she then lays down the cards in order of the letters in his/her word.

That word is then written anywhere on the blank crossword sheet with one letter per box. (The word must be written left to right or up to down and can go in only one direction in a turn.)

Those cards are now placed in a discard pile and the player draws enough new cards from the drawing pile to keep his hand at 7 cards.

The word value chart at the end of these instructions then gives that player the point value of his word as determined.

The next player must use one of the letters in his opponent's word to form another word as in a crossword puzzle. If a word placed on the crossword sheet touches any other letter, it must form a complete word using that letter.

After playing the new word, he/she receives the appropriate amount of points for that word. Additional points are received for any words constructed as a result of a new letter touching an existing letter.

Play continues in this manner until the drawing pile is depleted. (The discard pile may be reshuffled and the cards used over with the game continuing for a predetermined amount of time.)

At this point, players continue to play their cards until they cannot add or complete any new words on the game board.

The person with the most points is the winner

If a player so chooses, he may use a turn to exchange any or all of his 7 cards. He lays them in the discard pile and draws new cards to replace them. His turn is then over without being able to play a word.

Space Place™

Figure 14:
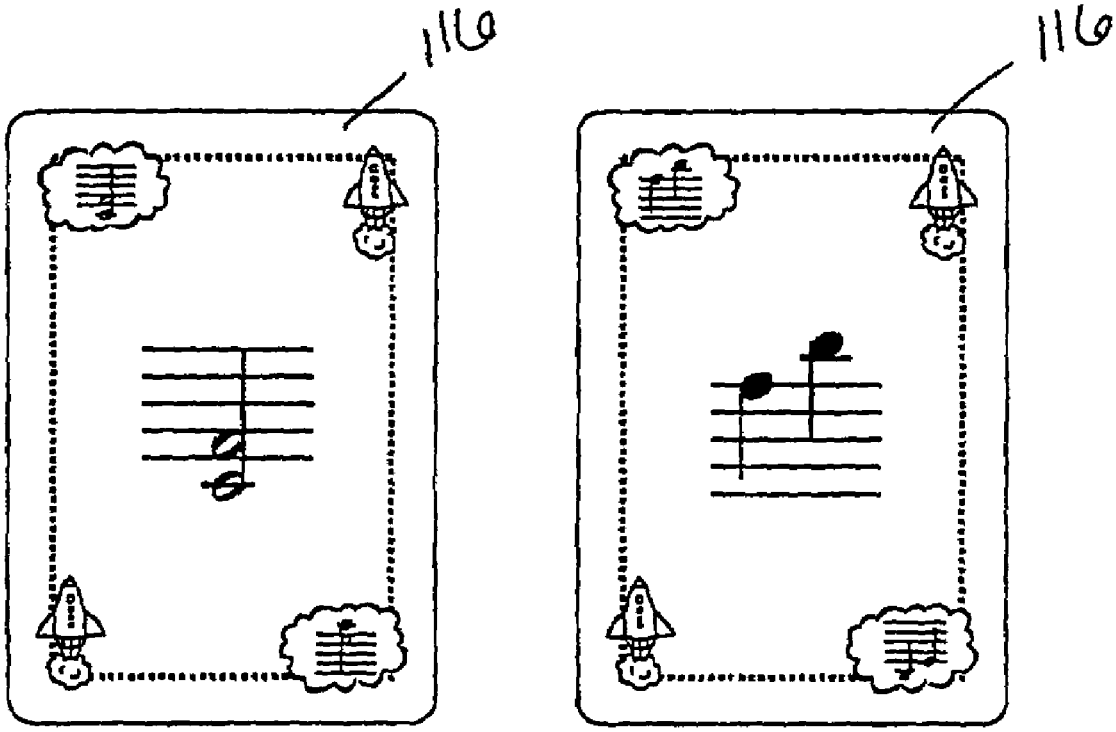
FIG. 14 shows playing cards for the Space Place™ game.
Figure 15:
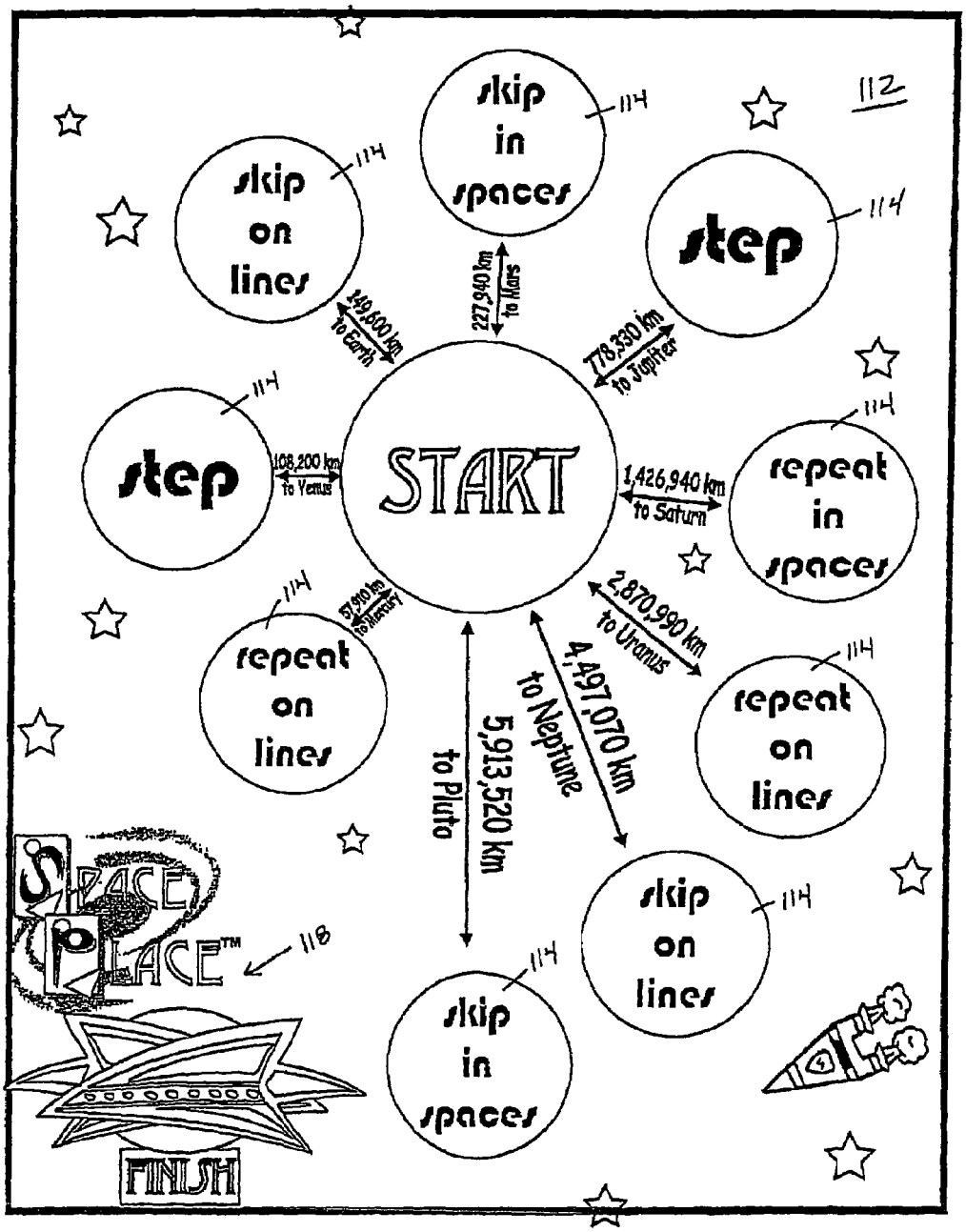
FIG. 15 shows a primer level playing board for the Space Place™ game.

Space Place™ is designed to help students understand the concept of distance and direction (intervals) in note reading as a preparation for not only performance, but also chord construction. In the illustrated embodiment, each game board 112 (FIG. 15) is an artistic rendering of our solar system. Each planet 114 is labeled with an interval. Players race from planet to planet around the solar system with the objective of being the first to pilot a rocket to the "Space Place™" 118 which is just beyond the planet Pluto. To proceed from one planet to another, players must collect two cards 116 (FIG. 14), each with the required interval labeled on the planet. Players collect their pairs of intervals by either drawing from remaining cards or asking for them from an opponent.

Figure 16:
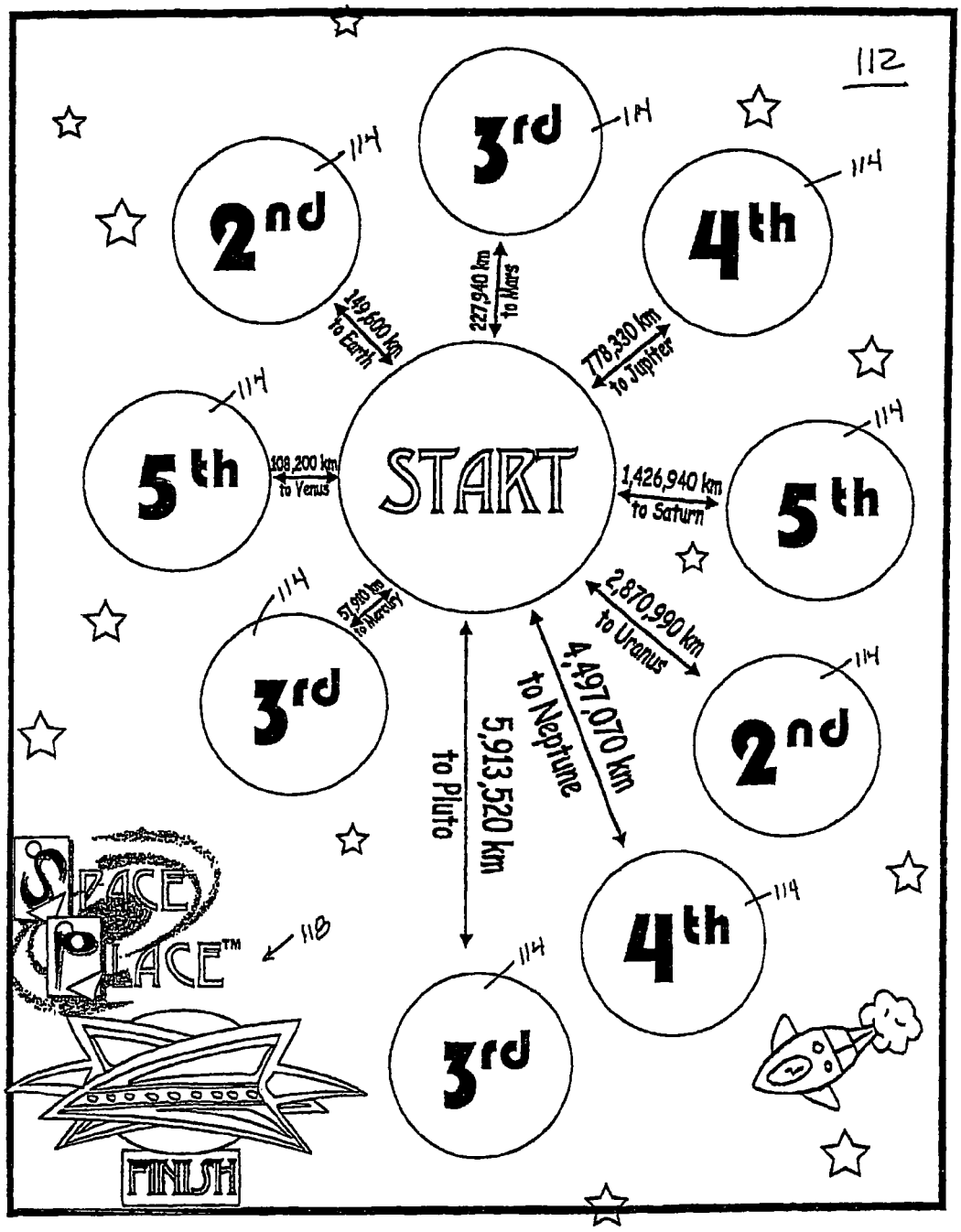
FIG. 16 shows a Level 1 playing board for the Space Place™ game.
Figure 17:
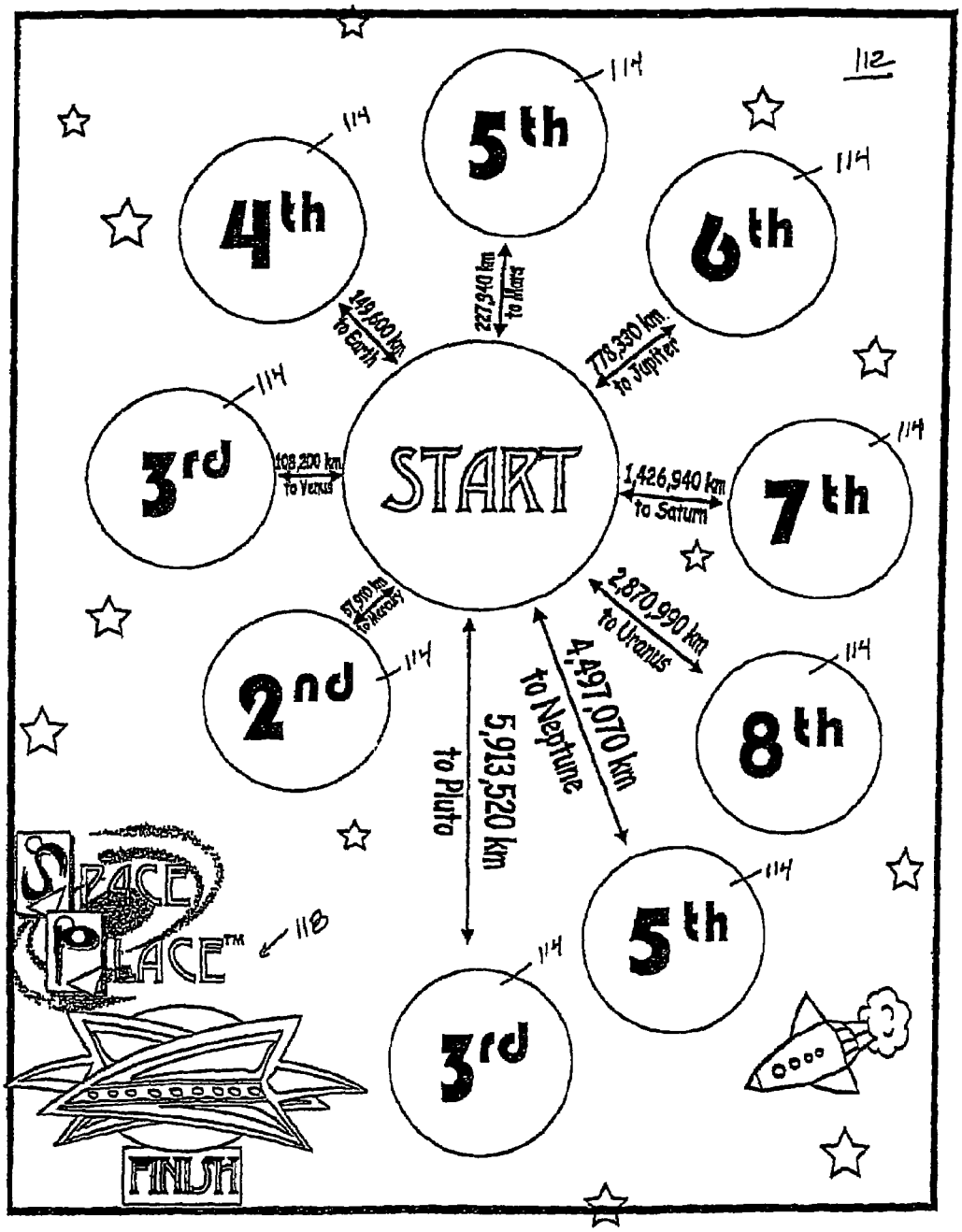
FIG. 17 shows a Level 2 playing board for the Space Place™ game.

A separate deck of note cards 116 is included for each level. The cards 116 do not have clef signs so that students must determine the interval and not the note names. In one example, Space Place™ is available in three levels. The primer level contains steps, skips, and repeated notes (See FIG. 15). There are both melodic and harmonic intervals included. This level serves as a preparatory game for the introduction of intervals. Level 1 contains intervals ranging from 2nd through 5th (See FIG. 16). Level 2 has intervals ranging from 2nd through 8th (See FIG. 17). The illustrations include but are not limited to the note placement or intervals indicated.

One reason this game is unique because Space Place™ has no clef signs so that players cannot determine intervals by figuring out note names. The design of the games stresses and reinforces the concept of distance and direction, which is essential for the performance of keyboard music and lays a good foundation for chord construction and harmonic structure.

Hereinbelow is provided an example of a detailed set of instructions for playing the Space Place™ game. The game pieces include: 4 Solar System playing boards labeled with intervals, 4 rocket playing pieces, and a deck of interval cards (containing both harmonic and melodic intervals) along with two wild cards. The "Parent Cheat Sheet" is on the back of the game cover sheet.

Setup:

Each player chooses a solar system game board and a rocket.

Each pilot places his or her rocket on "start" on the sun of his or her own game board.

Players are each dealt 5 cards. The remainder of the deck is then used for the drawing pile.

The Game:

Players determine who goes first by each drawing a card. The card with the largest interval starts. In the event of a tie, all players draw over.

The rocket moves one planet at a time through the solar system, as the pilot collects the needed pairs of intervals. A pair consists of any two cards with the same interval regardless of where the interval occurs on the staff. A pair may consist of a wild card and a card with the needed interval.

Pilots have 3 options but may only choose one per turn:

1. If the player has in his hand two cards with the intervals required to make his next move (the needed interval is labeled on the planet) the pair can be laid down and the rocket belonging to that pilot can be moved there. The cards which have been laid down then go into the discard pile and the turn is over. or
2. The player may draw two cards from the drawing deck. The pilot's turn is then over and he/she cannot lay down any pairs until the next turn. or
3. If the pilot has one card with the required interval, or a wild card, he/she may ask one opponent for a matching interval card. If the opponent has the requested card, it must be surrendered (wild cards do not need to be surrendered). The pair may then be laid down and the rocket may be moved to the next planet. The turn is then over. If the opponent does not have the match, the pilot's turn is over.

Play progresses from one planet to the next in the order of their distance from the sun.

To move to the Space Place from Pluto, the player must produce a pair of any interval.

If at any time there are no cards left in the drawing pile, the discard pile is reshuffled and becomes the new drawing pile.

The first player to reach the Space Place is the winner of the game.

Additional Information:

Pilots can recognize intervals more quickly by determining whether the interval number is odd or even. Odd intervals are both on lines or both on spaces. Even number intervals are line/space combinations.

A pilot may ask only for the interval required to make his or her next move.

A pair may consist of two wild cards.

Sample Turn:

Example: Pilot A is on the sun and needs to move to Mercury. On pilot A's game board Mercury has "3$^{rd}$" on it. Pilot A needs a pair of cards which show a 3$^{rd}$. If he/she already has one card that works, he/she can draw two cards from the draw pile (in which case the turn would be over), or the pilot may ask one of the other players for the match. Upon receipt of that second card, the pair can be laid down and Pilot A can move his/her rocket to Mercury. If the opponent does not have the requested interval, Pilot A's turn is over.

Legato Lake™

Figure 18:
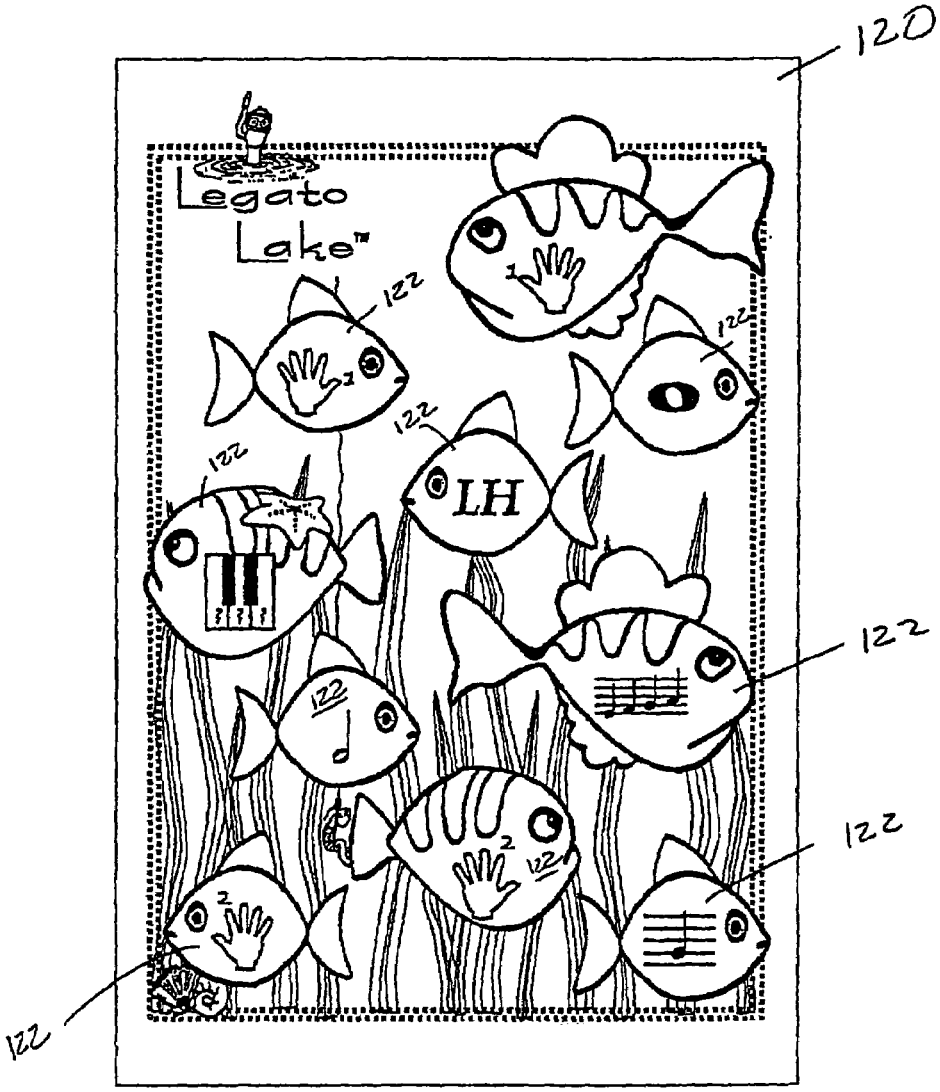
FIG. 18 shows a playing board for the Legato Lake™ game.
Figure 19:
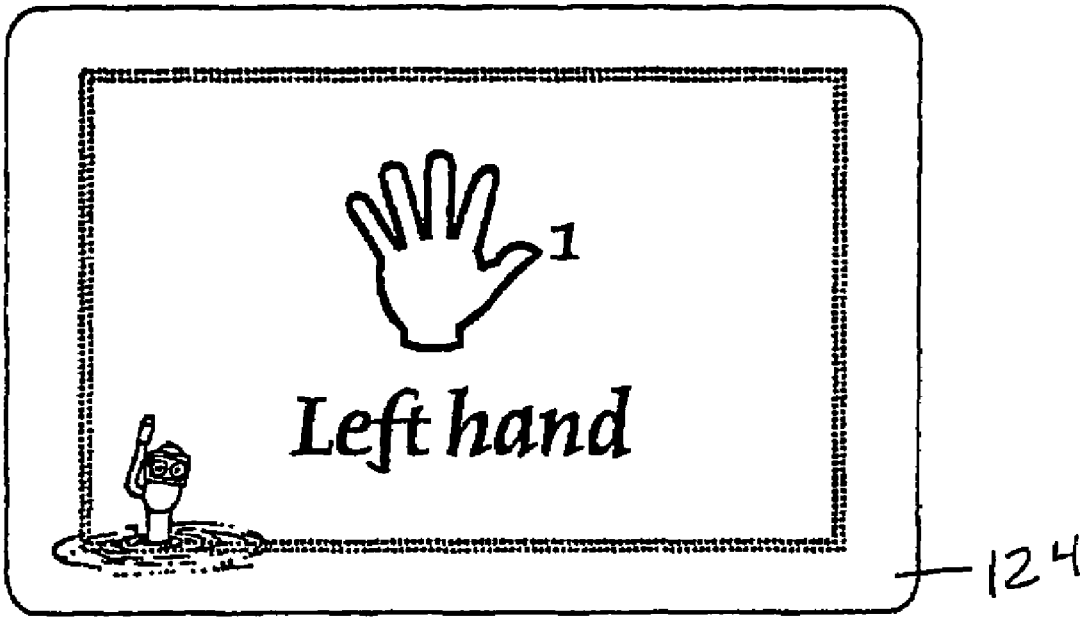
FIG. 19 shows an exemplary playing card for the Legato Lake™ game.
Figure 20:
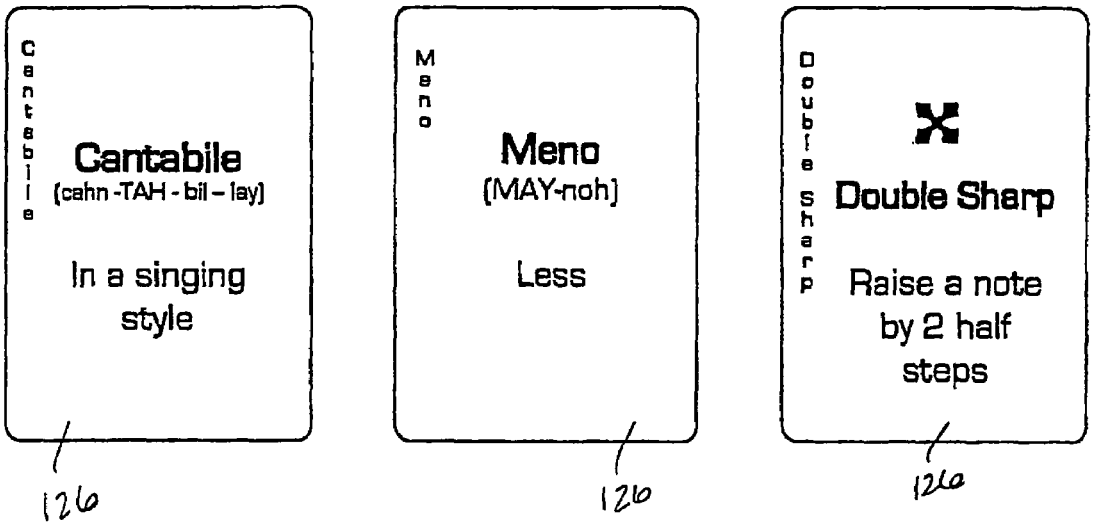
FIG. 20 shows playing cards for the Ostinato™ game.

Legato Lake™ is a game that concentrates on music terms and symbols. In the depicted embodiment, each game board 120 (See FIG. 18) is a lake containing fish 122 with symbols or terms marked on their sides. Players draw from a deck of cards 124 (See FIG. 19) and identify the music term indicated on the card. Each player then "catches" (covers with a marker) any fish marked with that term. The first player to catch all the fish in his/her lake is the winner.

There are many variations in how the game is played depending on the level of understanding of the players. Each game contains a wild worm card, which can "catch" any fish. The illustrations include but are not limited to the terms indicated.

Legato Lake™ addresses the needs of a beginning through early intermediate music student. It is not piano-specific with the exception of the primer A level which includes piano key names and piano right and left hand finger numbers, and can be used to teach and reinforce music concepts for any music student, whether instrumental or vocal. Not only do students need to recognize the beginning language of music but they also need to keep advancing and Legato Lake™ presents a logical plan for that advancement. In addition, the game boards 120 are marked with the music symbols and terms but the cards 124 contain the definition as well so they make it possible to change the manner of playing so that a student may be "the caller" and learn to define the terms as they play the game.

Hereinbelow is provided an example of a detailed set of instructions for playing the Legato Lake™ game. Each level includes Legato Lake™ playing boards with musical fish, "bait" cards with the music symbols and their definitions and one "wild worm" card. Multi-colored game pieces are also included.

Setup:

Each player chooses a lake board and the game pieces are made available to all players.

One player is chosen to be the caller of the music terms on the bait cards.

The bait cards are shuffled and placed in front of the caller.

The Game:

The caller draws the top card on the pile of bait cards and without showing the card to the other players, announces the music symbol on the card.

Any player with that symbol on a fish on their lake board, places a game piece on that fish and it is "caught". The play continues with the next bait card.

The "Wild Worm" can catch any fish. When a "Wild Worm" is drawn, each player can catch a fish of his/her own choosing. Before "catching" a fish with the "Wild Worm", the player must define the symbol that is labeled on that fish, then may place a game piece on the chosen fish.

The first fisherman to catch all the fish in his lake has won the game.

Exceptions:

For beginning players it may be necessary to show the bait card when announcing the music symbol.

Additional Information:

When playing Level 2, it is recommended that the caller for the "bait" cards say the word that is printed in blue. Depending on the level of the players, the term or symbol may need to be defined by the player before the worm is placed on the fish, or the definition may need to be part of the clue to help the less experienced musicians.

Ostinato™

Ostinato™ is a more advanced form of Legato Lake™. This game can be played in different ways. A fast-paced, bingo-style game can be played. The first player to complete two sets of four markers in a row is declared the winner. Each card includes the music symbol or term along with its definition (See FIG. 19). The game board includes only the term or symbol (no graphic included). Music terms and symbols are announced as cards are drawn from a pile. Wild cards with various instructions add to the chance and strategy aspect of this game. Many variations are included (in the instructions) to add to the versatility of this game. The illustrations include but are not limited to the terms indicated.

Ostinato can alternately be played by dealing hands of cards. This game uses the game board 128 (See FIG. 21) containing two sets of symbols and terms and is played with the entire Ostinato deck of cards. Each player endeavors to complete two sets of four in a row by placing a card from his/her hand on the play pile and covering a matching symbol or term on the game board 128. Once a play is made the player draws a new card from a draw pile. Players are able to block an opponent from making a set and use strategy to form their own lines of four. This results in a longer game but with more terms defined. Wild cards are also used in this game to add an extra element of chance and strategy.

Intermediate and advanced terms and symbols are included in this game. The deck of cards concentrates on many symbols and terms but also concepts dealing with various modifications of performance and style.

Ostinato™ presents music terms and symbols in a manner more suited to the intermediate and more advanced students. Players compete by defining and recognizing more advanced music terminology and articulation. This is different from other games because it addresses more complex terms and presents them in a more enjoyable form than the basic theory books that are presently available.

It's All Relative™

Figure 22:
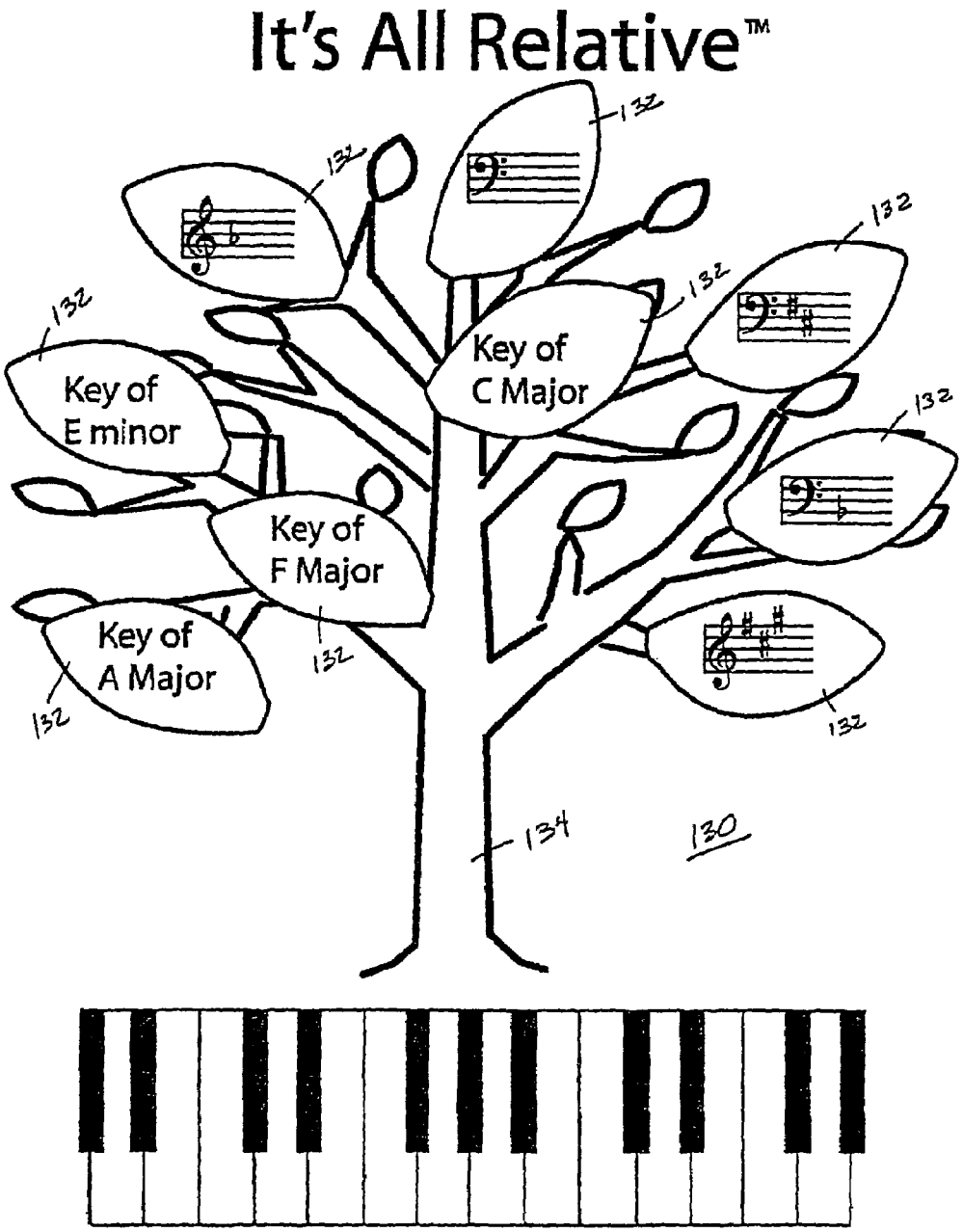
FIG. 22 shows a playing board for the "It's All Relative™" game.
Figure 23:
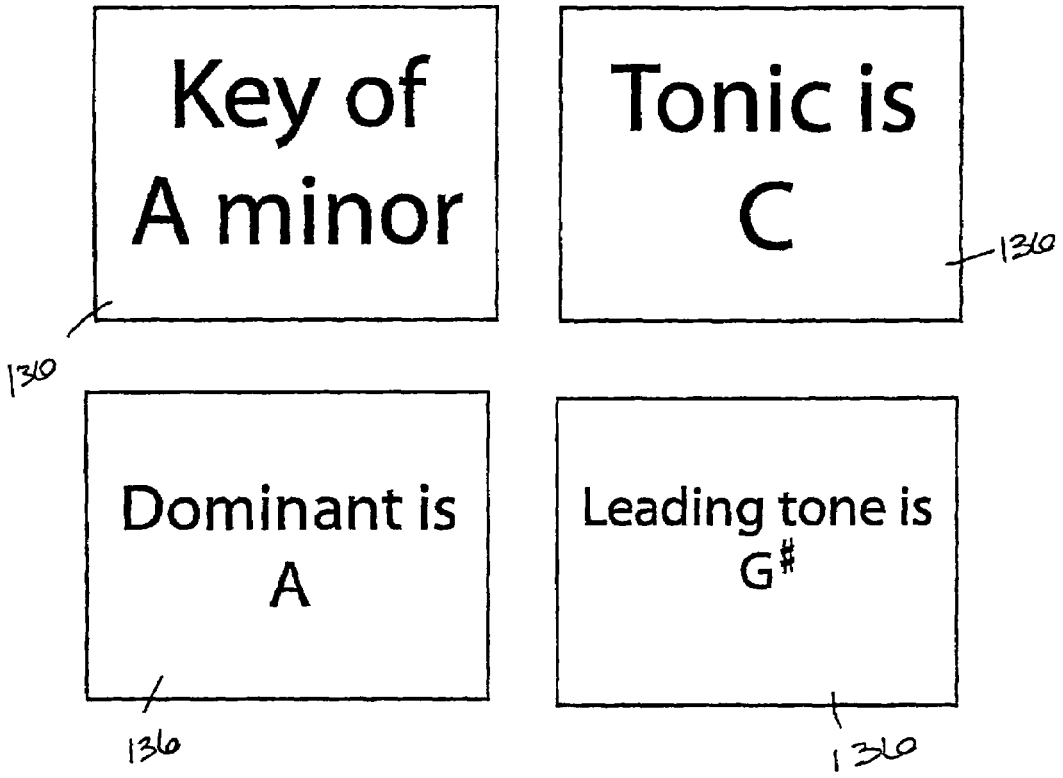
FIG. 23 shows playing cards for the "It's All Relative™" game.

It's All Relative™ concentrates on key signatures, both major and minor, along with scale degrees (tonic, dominant, subdominant, leading tone etc.) In a preferred embodiment, the game is divided into two levels. Level 1 serves as an introductory game concentrating on keys with three sharps or three flats or fewer. Level 2 uses all key signatures. Each player has a game board 130 with a "family tree" 134 (See FIG. 22). The trees have blank spaces 132 that players try to fill in after drawing cards 136 (See FIG. 23) with clues that relate to a particular branch of the tree 134. The winner is the player with a tree 134 that has had all spaces 132 filled in. The cards 136 can pertain to more than one key or key signature. For example, the clue "A is the tonic note" could pertain to the key of A Major, A minor, three sharps, or no sharps or flats. Each player has to choose where to place that card 136 on his/her own tree 134 so players must use strategy to win the game. The illustrations include but are not limited to the key signatures and scale degrees indicated.

One reason this game method is unique is because no other game directly deals with relative Major and Minor keys along with scale degrees and tonic, dominant, subdominant, leading tone, etc. It is also very unusual in that a clue card 136 will have more than one correct or appropriate position on the tree 134. For example, the clue "the dominant note is A" could refer to the key of D Major, D minor, two sharps, or one flat so a player must use strategy to determine where he/she would gain the most advantage before making a play.

Rhythm Riot™

Figure 24:
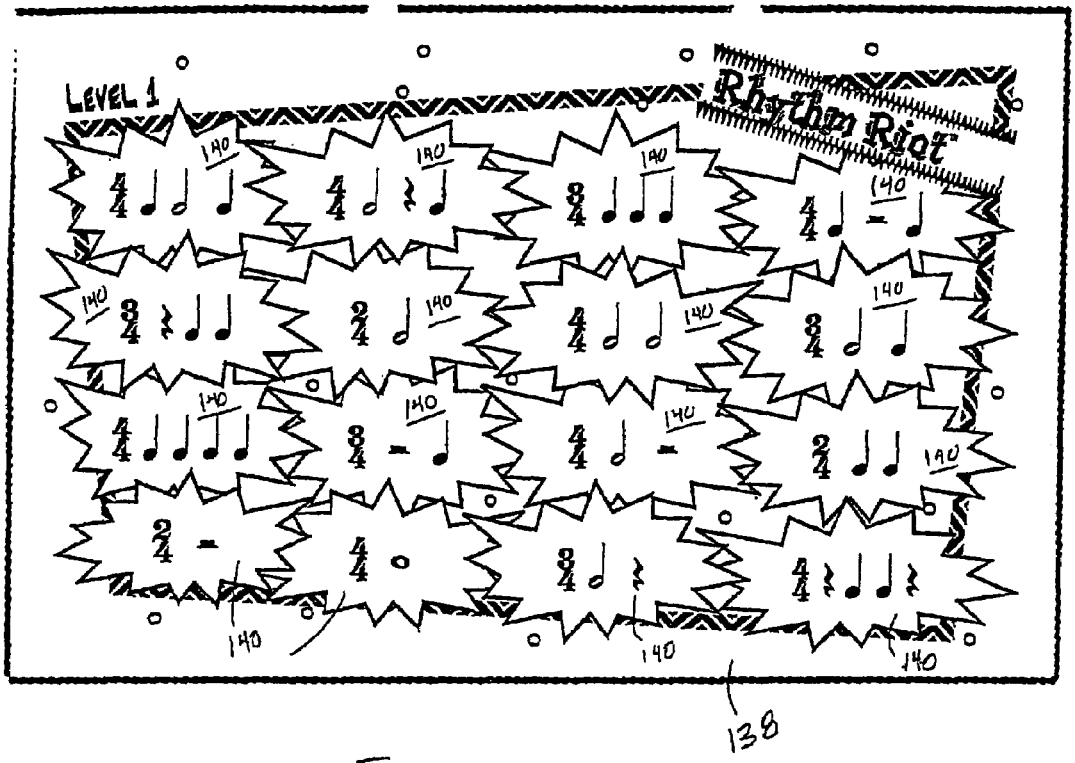
FIG. 24 shows a playing board for the Rhythm Riot™ game.

Rhythm Riot™ is a game that deals with rhythm and tempo. In a preferred embodiment, each player receives a game board 138 having "bursts" 140 of one-measure rhythms (See FIG. 24). The objective is to be the first player to obtain four marked rhythms in a row (a "Riot"), or to get as many Riots as time allows.

Figure 26:
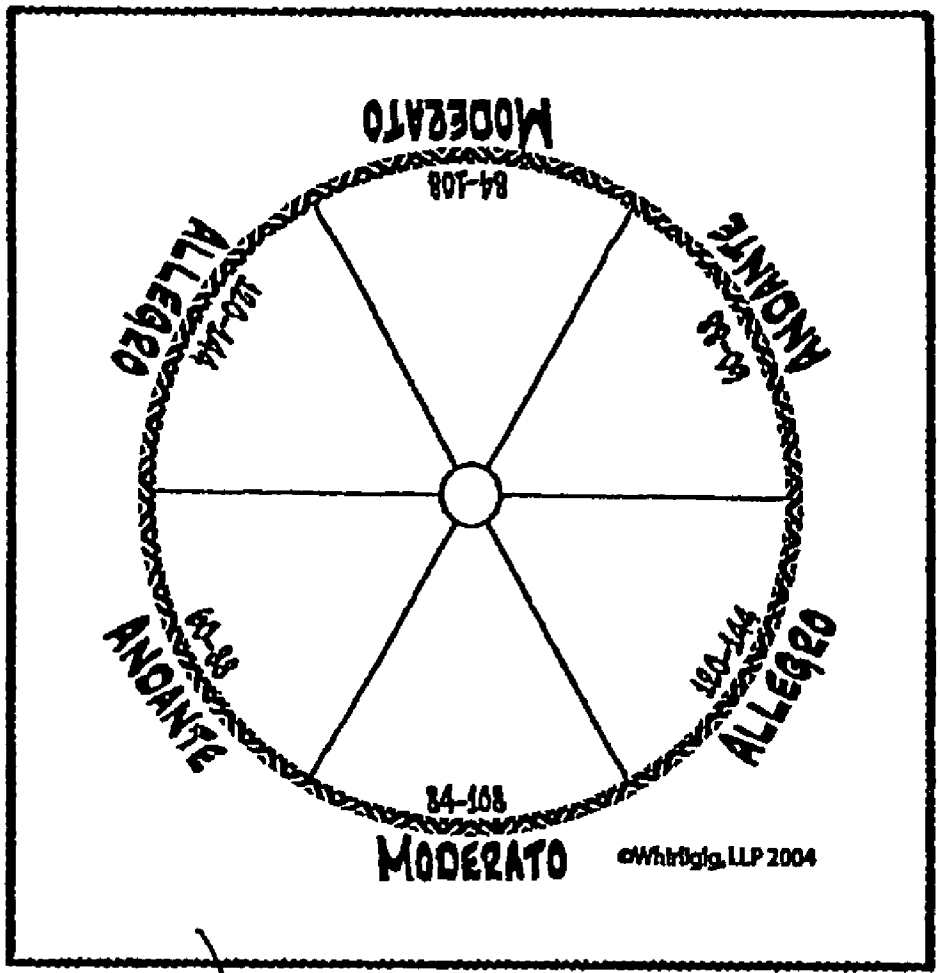
FIG. 26 shows a spinner for the Rhythm Riot™ game.

To play, a player draws a card 142 from a deck of playing cards (See FIG. 25), and after identifying the time signature, spins a tempo spinner 144 (See FIG. 26) to determine the speed at which the rhythm should be performed. After setting a metronome to the appropriate speed, players perform that rhythm either by clapping or using different rhythm instruments. Each player with a game board 138 containing that rhythm, places a marker covering the performed burst 140.

Figure 27:
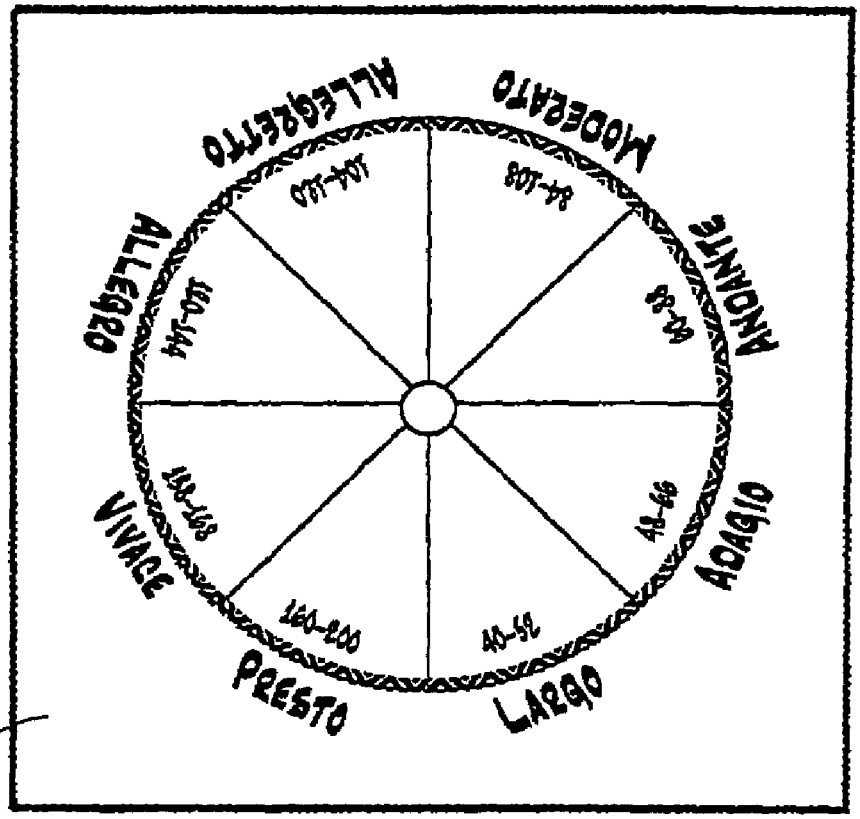
FIG. 27 shows a spinner for the Rhythm Riot™ game.

Each level of Rhythm Riot™ gets progressively more difficult. Level 1 includes basic rhythms with quarter, half, dotted half, and whole notes and rests in quarter time. As the levels advance, eighth, sixteenth notes and rests, dotted notes, and triplets are included, along with more complex rhythm patterns. Levels 5 and 6 are played in eighth and half time. In addition to the changes in time signatures and rhythms, the tempo spinner 144 can include more complex tempo terms as the levels of rhythm difficulty increase (See FIG. 27). This game includes but is not limited to the terms and symbols described.

One reason this game is unique is because although there are some rhythm games in prior art, none advance through enough levels to include complicated rhythms. In addition, the inclusion of a tempo spinner teaches not only rhythms but also their progression through real time. Players learn to perform rhythms accurately but also in required tempos.

Hereinbelow is provided an example of a detailed set of instructions for playing the Rhythm Riot™ game.

Set Up

- Each player chooses a game board.
- Plastic markers are made available to all players.
- The deck of rhythm cards is positioned so that all players have access to it.

Play

- The first player draws a rhythm card and spins the tempo spinner.
- He/she then announces the time signature for the drawn rhythm and sets the metronome to the appropriate tempo (listed tempos are approximate).
- The card is positioned where all players can see it.
- All players count aloud one free measure and then perform that rhythm with the metronome while continuing to count together.
- Players with the selected rhythm on their game board place a colored marker on that rhythm burst. When a wild card is drawn each player marks the burst of his/her choice but must count and clap that rhythm before covering the burst with a marker.
- The first player to get (four bursts in a row) has a "RIOT" and is declared the winner of the game.

Additional Suggestions

- The game can be played without the spinner and metronome.
- Rhythms may be performed on drums or other musical instruments.
- Only the player who draws the card performs the rhythm.
- Rhythms may be performed only by the player drawing the cards but with the card not shown to others.
- Players must identify that rhythm by listening and without seeing the rhythm.
- Players can be assigned to be the "pulse" while others are the "rhythm" thus creating more independence with their performance.

"To Win" Modifications

- The first person to cover the entire game board or get a predetermined number of "Riots" is declared the winner.
- A time limit is set for the game and each player is given one point for each "RIOT" on his/her game board.
- The player with the most points is the winner. If after the set amount of time has been reached no one has a "RIOT" the player with the most bursts covered is declared the winner.

Wild Card Modifications

- When a wild card is drawn, the only person to cover a burst is the player who turned up the card.
- Wild cards may be omitted for a longer game.
- A wild card can cover any rhythm burst but cannot result in a "Riot".

Composer Chaos™

Composer Chaos™ teaches musical form and style along with composers, instrumentation, and music time lines. Players compete to be the first to get rid of cards in their hands by forming sets or adding to opponent's sets.

Figure 32:
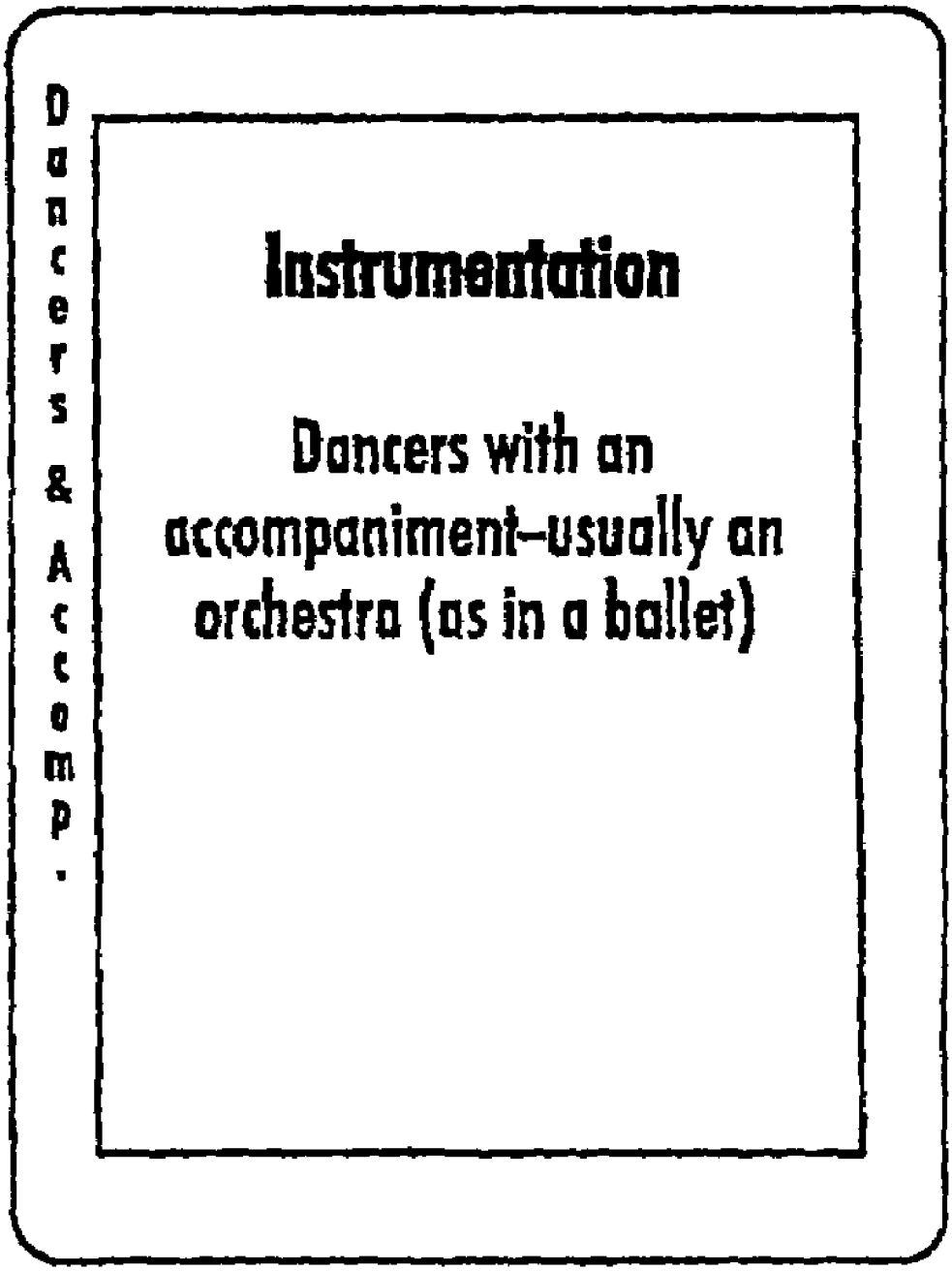
FIG. 32 shows an instrumentation card for the Composer Chaos™ game.

A set consists of a musical composition, its composer, its style or form, the era in which it was composed, and the correct instrumentation for its performance. Each card contains information or clues to the matching cards. The composer card 146 tells facts about the composer (See FIG. 28), the composition card 148 gives information about the composition itself (See FIG. 29), the era card 150 states typical styles and forms of music along with other information about that period of history (See FIG. 30), the style or form card 152 tells about the style or form of a particular type of musical composition (See FIG. 31), and the instrumentation card 154 indicates what group of musicians or performers for which the composition was written (See FIG. 32).

Each player is dealt a hand of cards and players take turns drawing and discarding to collect cards needed to form a set. The amount of cards dealt to each player depends on the number of persons playing. In the course of the game, players lay down sets of three cards that match. One of those cards must either be a composer card 146 or a composition card 148. Once a set of three is played, opponents may add to that set after making their own initial set of at least three cards. For example if player A places a Chopin card, a romantic era card, and a piano card in front of him, he has made a partial set. If player B has already played at least one set of three, he may add a composition card and/or a style or form card to the set belonging to player A. Each player can continue to play as many cards during a turn as he/she can. When the turn is over, he must discard one card from his/her hand. The first player to use all of the cards in his/her hand is the winner.

One reason this game is unique because it teaches many elements of a composition. Students learn to appreciate the aspects of music beyond the basic notes and rhythms. The cards contain information about the compositions, composers, musical form and style, and typical instrumentation, era in which the composition was written, which gives them a better understanding of all music. To collect matches, players must read the cards and get clues as to which other cards have the appropriate connections. In addition to giving information about the compositions included in this game, the cards also list other famous pieces by each composer.

Another unique aspect of this game is the fact that there are at least four different eras addressed with separate decks of cards. When used together they will give a student an understanding of the many facets of music history. They can also be used individually by era. The Baroque era game can be used by itself for a more complete concentration on baroque composers and compositions. In like manner, each of the other eras can be played alone. This game includes but is not limited to composers from the Baroque, Classical, Romantic, and Contemporary Eras. In addition, supplemental decks can be added to increase the number of composers and compositions from each era and study each category in more depth.

The invention claimed is:

1. A method of playing an educational music theory game, the method comprising the steps of:

(a) providing a game board depicting a path of movement that includes a set of piano keys, a finishing stage, and a plurality of stores, each store designating a different category of music theory, one of which is music intervals;

(b) spinning a spinner to randomly indicate one of a note name and an interval;

(c) moving a playing pawn along the set of piano keys by matching one of the note name and interval indicated by the spinner with the corresponding key on the set of piano keys;

(d) repeating steps (b) and (c) until the playing pawn is moved into and occupies one of the stores;

(e) answering a question regarding the category of music theory designated by the occupied store;

(f) repeating step (e) until a predetermined number of questions are answered correctly;

(g) collecting a token indicating completion of the occupied store once the predetermined number of questions are answered correctly;

(h) repeating steps (b) through (g) until a token is collected from each of the plurality of stores;

(i) moving the playing pawn to the finishing stage and answering a predetermined number of questions correctly to complete the game; and (j) playing a focus game related to music intervals if a predetermined number of questions are answered incorrectly in step (e) for the store that represents music intervals, the focus game further developing understanding of music intervals and comprising the steps of:

(i) providing a focus game board having a path of movement that includes a start, a finish, and a plurality of steps between the start and finish, wherein each of the plurality of steps has indicia referring to a particular music interval;

(ii) drawing a plurality of playing cards from a deck of playing cards, each of the playing cards having indicia that denotes a particular music interval;

(iii) matching a pair of the playing cards drawn from the deck, wherein the pair have different indicia, respectively, but refer to the same music interval;

(iv) matching the interval referred to by the pair of playing cards with the interval indicated a step in the path of movement; and (v) repeating steps (ii) through (iv) until pairs of cards are matched to each of the steps in the plurality of steps.

2. The method of claim 1, wherein the indicia on some of the playing cards includes notes on a musical staff, but does not include a cleff sign.

3. A method of playing an educational music theory game, the method comprising the steps of:

(a) providing a game board depicting a path of movement that includes a set of piano keys, a finishing stage, and a plurality of stores, each store designating a different category of music theory, one of which is music key signatures and scale degrees;

(b) spinning a spinner to randomly indicate one of a note name and an interval;

(c) moving a playing pawn along the set of piano keys by matching one of the note name and interval indicated by the spinner with the corresponding key on the set of piano keys;

(d) repeating steps (b) and (c) until the playing pawn is moved into and occupies one of the stores;

(e) answering a question regarding the category of music theory designated by the occupied store;

(f) repeating step (e) until a predetermined number of questions are answered correctly;

(g) collecting a token indicating completion of the occupied store once the predetermined number of questions are answered correctly;

(h) repeating steps (b) through (g) until a token is collected from each of the plurality of stores;

(i) moving the playing pawn to the finishing stage and answering a predetermined number of questions correctly to complete the game; and (j) playing a focus game related to key signatures and scale degrees if a predetermined number of questions are answered incorrectly in step (e) for the store that represents key signatures and scale degrees, the focus game further developing understanding of key signatures and scale degrees and comprising the steps of:

(i) providing a focus game board having a plurality of spaced apart indicia, wherein each of the indicia refers to a particular key signature and a scale degree;

(ii) drawing a plurality of playing cards from a deck of playing cards, each of the playing cards having indicia that denotes a key signature and a scale degree;

(iii) matching the key signature or scale degree referred to by the drawn card with either the key signature or the scale degree indicated on the game board; and (iv) repeating steps (ii) through (iii) until cards are matched to each of the plurality of spaced apart indicia.

4. The method of claim 3 wherein the key signatures include both major and minor signatures.

5. The method of claim 4 wherein the scale degrees include tonic, dominant, subdominant and leading tone.

6. A method of playing an educational music theory game, the method comprising the steps of:

(a) providing a game board depicting a path of movement that includes a set of piano keys, a finishing stage, and a plurality of stores, each store designating a different category of music theory, one of which is rhythm, tempo and time signatures;

(b) spinning a spinner to randomly indicate one of a note name and an interval;

(c) moving a playing pawn along the set of piano keys by matching one of the note name and interval indicated by the spinner with the corresponding key on the set of piano keys;

(d) repeating steps (b) and (c) until the playing pawn is moved into and occupies one of the stores;

(e) answering a question regarding the category of music theory designated by the occupied store;

(f) repeating step (e) until a predetermined number of questions are answered correctly;

(g) collecting a token indicating completion of the occupied store once the predetermined number of questions are answered correctly;

(h) repeating steps (b) through (g) until a token is collected from each of the plurality of stores;

(i) moving the playing pawn to the finishing stage and answering a predetermined number of questions correctly to complete the game; and (j) playing a focus game related to rhythm, tempo and time signatures if a predetermined number of questions are answered incorrectly in step (e) for the store that represents rhythm, tempo and time signatures, the focus game further developing understanding of rhythm, tempo and time signatures and comprising the steps of:

(i) providing a focus game board having a plurality of spaced apart indicia, wherein each of the indicia portrays a one-measure rhythm;

(ii) drawing a playing card from a deck of playing cards, the playing card having indicia that denotes a time signature and a one measure rhythm;

(iii) spinning a spinner to randomly indicate a tempo;

(iv) performing the indicated rhythm at the indicated tempo and time; and (v) repeating steps (i) through (iv) to better understanding of rhythm, tempo and time.

* * * * *